US005261341A

United States Patent [19]

Asano

[11] Patent Number: 5,261,341

[45] Date of Patent: Nov. 16, 1993

[54] PROCESS AND APPARATUS FOR PRODUCING EMBROIDERY DATA BY USING BLOCKS WITH VARIOUS SHAPES AND UTILIZING EMBROIDERY DATA TO FORM A STITCH LINE

[75] Inventor: Fumiaki Asano, Nagoya, Japan

[73] Assignee: Brother Kogyo Kabushiki Kaisha, Nagoya, Japan

[21] Appl. No.: 971,067

[22] Filed: Nov. 3, 1992

[30] Foreign Application Priority Data

Nov. 5, 1991 [JP] Japan ..... 3-318475

[51] Int. Cl.[5] ..... D05B 21/00

[52] U.S. Cl. ..... 112/266.1; 112/121.12; 364/470

[58] Field of Search ..... 112/121.12, 103, 121.11, 112/102, 457, 266.1, 262.3; 364/470

[56] References Cited

U.S. PATENT DOCUMENTS

| | | | |
|---|---|---|---|
| 4,388,883 | 6/1983 | Hirota et al. | 112/121.12 |
| 4,413,574 | 11/1983 | Hirota et al. | 112/121.12 |
| 4,622,907 | 11/1986 | Kimura | 112/103 X |
| 4,991,524 | 2/1991 | Ozaki | 112/103 |
| 5,054,408 | 10/1991 | Hayakawa | 112/103 |

FOREIGN PATENT DOCUMENTS

| | | | |
|---|---|---|---|
| 2-307956 | 12/1990 | Japan | 112/103 |

*Primary Examiner*—Peter Nerbun
*Attorney, Agent, or Firm*—Oliff & Berridge

[57] ABSTRACT

Process and apparatus for producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, a stitch line consisting of a series of the stitches alternately turning at the opposed main outline segments, thereby providing an embroidery in the embroidery area. The process comprises the steps of: specifying a set of secondary outline segment shape defining data defining a shape of each of the secondary outline segments such that the shape of the each secondary outline segment is different from a straight line segment; and producing, based on the main outline segment data and the secondary outline segment shape defining data, the sets of stitch position data which are representative of respective stitch positions located on a stitch forming path alternately turning at the opposed main outline segments, the stitch forming path consisting of a plurality of path segments each of which connects between the main outline segments and has a shape influenced by the shapes of the secondary outline segments.

26 Claims, 28 Drawing Sheets

FIG. 25

| | START POINT | END POINT | SHAPE | | |
|---|---|---|---|---|---|
| | | | | 凹/凸 | RADIUS |
| L1 | P1(x1,y1) | P3(x3,y3) | arc | 凸 | $r_1$ |
| L2 | P2(x2,y2) | P4(x4,y4) | arc | 凹 | $r_2$ |
| L3 | P1(x1,y1) | P2(x2,y2) | arc | 凹 | $r_3$ |
| L4 | P3(x3,y3) | P4(x4,y4) | arc | 凹 | $r_4$ |

PROCESS AND APPARATUS FOR PRODUCING EMBROIDERY DATA BY USING BLOCKS WITH VARIOUS SHAPES AND UTILIZING EMBROIDERY DATA TO FORM A STITCH LINE

BACKGROUND OF THE INVENTION

1. Field of the Invention

The present invention generally relates to the art of producing stitch position data utilized by a sewing machine for forming an embroidery, and particularly to the art of producing stitch position data for forming stitches accurately reflecting the shape of an embroidery area while at the same time largely reducing the number of blocks as divisions of the embroidery area and increasing the degree of freedom as to the shapes of the blocks.

2. Related Art Statement

U.S. Pat. No. 4,388,883 discloses a sewing system which stores embroidery data used for forming an embroidery, with the least possible storage capacity. More specifically, the disclosed system stores embroidery area data including sets of block data each of which is representative of outline segments which cooperate with each other to define a corresponding one of blocks as divisions of an embroidery zone or area to be filled with stitches to provide an embroidery such as an alphabetic character or a figure. The embroidery area data additionally includes stitch density data indicative of a number of stitches formed in each of the blocks using thread. The sewing system automatically produces, based on the block data and the stitch density data, sets of stitch position data representative of respective stitch positions where a sewing needle penetrates a work cloth to form respective stitches filling each of the blocks. A stitch-forming device including the sewing needle, of the sewing system, utilizes the stitch position data for forming respective stitches and thereby providing an embroidery in the embroidery area.

In the event that embroidery area data is prepared for being stored in the above-identified sewing system, generally, an original embroidery area is divided into a plurality of simple blocks such as quadrangles and/or triangles, for forming individual stitches with excellent appearance. When embroidery area data is prepared for, for example, a "leaf" embroidery area 100 as shown in FIG. 23, first, the "leaf" area 100 is divided into a left-hand and a right-hand area, and then the left-hand area is divided into three blocks, B1, B2, B3, and the right-hand area is divided into three blocks, B4, B5, B6. The sewing system prepares the embroidery area data, based on sets of block data for the respective blocks B1 to B6, and stitch density data, and stores the area data.

The set of block data for the block B1, for example, includes four sets of point data representative of four defining points, b11, b12, b13, b14, which cooperate with each other to define four segments, L1, L2, L3, L4, of the outline of the block B1, that is, four vertices defining the four sides of the quadrangle B1. Stated differently, the block B1 is defined by a pair of opposed main outline segments L1, L2 and a pair of opposed secondary outline segments L3, L4 connecting between corresponding pairs of opposed ends of the main outline segments L1, L2. Stitch positions are located on the two (first and second) main outline segments L1, L2. However, in the prior art, under the strict requirement that the (first or second) secondary outline segment L3, L4 which is shared by any adjacent two blocks be defined by a straight line segment, an embroidery area is divided into blocks by determining the number of blocks and the locations of division depending upon the shape of the embroidery area.

The known sewing system stores embroidery area data including block data for the blocks obtained under the above-indicated requirement, and produces, by utilizing the embroidery area data, embroidery data, i.e, stitch position data representative of stitch positions on the main outline segments of each of the blocks. FIG. 23 shows stitches formed by the known sewing system by using the thus produced embroidery data for the embroidery area 100.

Since the prior sewing system is thus required to prepare block data for the blocks whose secondary outline segments are straight line segments, the degree of freedom as to the shapes of blocks which are treated by the sewing system, is insufficiently low. In the event that a character, a symbol (including a logo or a mark), or a figure (representing an animal, a flower, an article, etc.), each having a complex profile whose outline includes a curved or polygonal line segment, is divided into blocks, the embroidery portion defined by the curved or polygonal line segment must be divided into a number of small blocks such that the straight line segments as the secondary outline segments of the blocks sufficiently approximate or match the curved or polygonal line segment. Thus, the number of blocks as divisions of an embroidery area is largely increased, and consequently the total amount of the embroidery area data is increased. In addition, the operation of preparing the embroidery area data is extremely complicated.

Furthermore, since an embroidery area is divided into a number of small blocks and stitches are formed in each of the small blocks, an embroidery as a whole suffers from the problem that the individual stitches thereof do not accurately reflect or represent the shape of the original outline of the embroidery area. In particular with respect to the embroidery area 100 of FIG. 23, adjacent two blocks, e.g., B1 and B4, B2 and B5, etc. are filled with stitches, independently of each other. As a result, a space may be left between the stitches formed in one of the two blocks and the stitches formed in the other block, thereby lowering the external appearance of the embroidery, i.e., quality of the embroidery product.

SUMMARY OF THE INVENTION

It is therefore an object of the present invention to provide a process and an apparatus for producing stitch position data for forming stitches accurately reflecting the shape of an embroidery area while at the same time largely reducing the number of blocks as divisions of the embroidery area and increasing the degree of freedom as to the shapes of the blocks.

The above object has been achieved by the present invention. According to a first aspect of the present invention, there is provided a process of producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, a stitch line consisting of a series of the stitches alternately turning at the opposed main outline segments, thereby providing an embroidery in the embroidery area, the process comprising the steps of (a) specifying a set of secondary outline segment shape defining data defining a shape of each of the secondary outline segments such that the shape of the each secondary outline segment is different from a straight line segment, and (b) producing, based on the main outline segment data and the secondary outline segment shape defining data, the sets of stitch position data which are representative of respective stitch positions located on a stitch forming path alternately turning at the opposed main outline segments, the stitch forming path consisting of a plurality of path segments each of which connects between the main outline segments and has a shape influenced by the shapes of the secondary outline segments.

In the stitch position data producing process as arranged described above, the main outline segment data and the secondary outline segment shape defining data are used as block data representative of the outline of a block as an embroidery area. The block may be a part of an embroidery area. The block data is utilized for producing stitch position data for stitch positions located on a stitch forming path consisting of path segments each of which connects between the main outline segments and has a shape influenced by the shapes of the secondary outline segments. The secondary outline segment shape defining data defines, as each of the secondary outline segments, any shape such as a polygonal line, a circular arc, or a free-form curve, or a combination of two or more of those shapes. Alternatively, one of the secondary outline segments may be a circular arc, and the other secondary outline segment may be a free-form curve. Therefore, such an embroidery area which must be divided into a plurality of blocks in the prior art, may not be divided in the present process and may be treated as a single block which is directly used for producing stitch position data. Stated differently, the outline of the embroidery area which includes a curved or polygonal line segment which must be reduced in the prior art to main outline segments of plural blocks, may be reduced to a secondary outline segment of a single block in the present process. Thus, the present process largely decreases the number of blocks as divisions of an embroidery area and increases the degree of freedom as to the shapes of the blocks to be treated. Accordingly, the present process largely reduces the amount of embroidery area data including block data for the blocks. In addition, the operation of preparing the embroidery area data is largely facilitated. Since the number of blocks is decreased, the number of spaces possibly left between the stitches formed in the blocks is decreased. Thus, the present process provides stitch position data which assures that an embroidery as a whole is formed with stitches accurately reflecting the outline of the embroidery area and having excellent appearance, thereby enjoying high quality. The work sheet on which the embroidery is provided may be any sheet such as a cloth, fabric, leather, synthetic-resin sheet, etc.

According to a feature of the present invention, the specifying step comprises specifying the secondary outline segment shape defining data including at least two sets of aid point data defining at least two aid points including at least one aid point located on each of the secondary outline segments. Usually, the number of aid point or points located on one of the two secondary outline segments is equal to that of aid point or points located on the other secondary outline segment.

According to another feature of the present invention, the main outline segment data includes a set of main outline segment shape defining data defining, as a shape of each of the main outline segments, at least one of a straight line, a polygonal line, a circular arc, and a free-form curve. Therefore, the main outline segment data may define, as each of the main outline segments, any shape such as a straight line, a polygonal line, a circular arc, or a free-form curve, or a combination of two or more of those shapes. Alternatively, one of the main outline segments may be a circular arc, and the other main outline segment may be a free-form curve.

According to yet another feature of the present invention, the specifying step comprises specifying the secondary outline segment shape defining data including at least two sets of aid point data defining at least two aid points including at least one aid point located on each of the secondary outline segments, and the producing step comprises (a) producing, based on the aid point data, at least one set of aid line data representative of at least one aid line each of which passes through a corresponding pair of aid points out of the at least two aid points one point of which pair is located on one of the secondary outline segments and the other point of which pair is located on the other of the secondary outline segments, and (b) producing, based on the main outline segment data, the aid line data, and stitch density data, the stitch position data including sets of stitch position data representative of stitch positions located on the at least one aid line. In this case, the secondary outline segment shape defining data may define, as the secondary outline segments, a pair of polygonal lines each of which contains as at least one vertex thereof an identical number of aid point or points out of the above-indicated at least two aid points.

In a preferred embodiment according to the first aspect of the present invention, the producing step comprises a step of producing stitch forming path data representative of the stitch forming path, and a step of producing the stitch position data based on the stitch forming path data and the main outline segment data.

In the above-indicated embodiment, the specifying step may comprise specifying the secondary outline segment shape defining data including at least two sets of aid point data defining at least two aid points including at least one aid point located on each of said secondary outline segments, and the producing step may comprise (a) a step of producing, based on the main outline segment data, at least one set of aid line data representative of at least one aid line each of which passes through a corresponding pair of aid points out of the at least two aid points one point of which pair is located on one of the secondary outline segments and the other point of which pair is located on the other of the secondary outline segments, and (b) the step of producing the stitch forming path data wherein the stitch forming path data is produced based on the aid line data and the secondary outline segment shape defining data, and further based on stitch density data for said at least one aid line. The stitch density data for the aid line may be indicative of a number of stitches formed in unit length on the aid line or lines, or a stitch pitch, i.e., length in which a stitch is formed on the aid line or lines. In this case, each of the path segments of the stitch forming path may be sewn with stitches whose number is greater by one than the number of the aid line or lines. Alternatively, stitch density data for the stitch forming path may be employed. The latter data may be indicative of a number of stitches formed in unit length on the stitch forming path. In the latter case, the stitch positions may, or may not, include stitch positions located on the aid line or lines.

In the above-indicated embodiment, the specifying step comprises specifying the main outline segment data including sets of end position data representative of respective positions of opposite ends of each of the main outline segments, and a set of main outline segment shape defining data defining a shape of the each main outline segment. In the case where the four ends of the main outline segments are defined by four intersections of three or more circles, the main outline segment data may include sets of position data for the centers of those circles and data indicative of the radii of those circles.

In another embodiment according to the first aspect of the present invention, the specifying step comprises specifying the secondary outline segment shape defining data including at least two sets of aid point data defining at least two aid points including at least one aid point located on each of the secondary outline segments, and the producing step comprises (a) producing, based on the aid point data and the main outline segment data including a set of main outline segment shape defining data defining a shape of each of the main outline segments, at least one set of aid line data representative of at least one aid line each of which passes through a corresponding pair of aid points out of the at least two aid points one point of which pair is located on one of the secondary outline segments and the other point of which pair is located on the other of the secondary outline segments, such that the each aid line has a shape influenced by the shapes of the main outline segments, and (b) producing the stitch position data based on the aid line data, the main outline segment data, the secondary outline segment shape defining data, and pre-specified stitch density data. In this case, the series of stitches providing the embroidery accurately reflects the shapes of the main outline segments in addition to the shapes of the secondary outline segments, thereby reflecting the shape of the embroidery area as a whole.

In yet another embodiment according to the first aspect of the present invention, the specifying step comprises specifying at least two sets of control point data representative of at least two control points including at least one control point which cooperates with each of two pairs of opposed ends of the opposed main outline segments, to define a Bezier curve as a shape of a corresponding one of the secondary outline segments, and the producing step comprises producing, based on the control point data and the main outline segment data, the stitch position data.

According to a second aspect of the present invention, there is provided a process of producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, a stitch line consisting of a series of the stitches alternately turning at the opposed main outline segments, thereby providing an embroidery in the embroidery area, the process comprising the steps of (a) specifying at least two sets of aid point data representative of at least two aid points including at least one point which is located on each of the secondary outline segments and defines a shape of the each secondary outline segment, and producing, based on the aid point data and the main outline segment data, the sets of stitch position data which are representative of respective stitch positions located on a stitch forming path alternately turning at the opposed main outline segments, the stitch forming path consisting of a plurality of path segments each of which connects between the main outline segments and has a shape influenced by the shapes of the secondary outline segments.

According to a third aspect of the present invention, there is provided an apparatus for producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, a stitch line consisting of a series of the stitches alternately turning at the opposed main outline segments, thereby providing an embroidery in the embroidery area, the apparatus comprising (a) means for specifying a set of secondary outline segment shape defining data defining a shape of each of the secondary outline segments such that the shape of the each secondary outline segment is different from a straight line segment, and (b) means for producing, based on the main outline segment data and the secondary outline segment shape defining data, the sets of stitch position data which are representative of respective stitch positions located on a stitch forming path alternately turning at the opposed main outline segments, the stitch forming path consisting of a plurality of path segments each of which connects between the main outline segments and has a shape influenced by the shapes of the secondary outline segments.

According to a fourth aspect of the present invention, there is provided a sewing system including a sewing needle which penetrates a work sheet to form stitches with a sewing thread, a stitch line consisting of a series of the stitches alternately turning at a pair of opposed main outline segments which define an embroidery area by cooperating with a pair of opposed secondary outline segments connecting between corresponding pairs of opposed ends of the main outline segments, the stitch line providing an embroidery in the embroidery area, the system comprising (A) a data producing apparatus for producing, based on main outline segment data representative of the pair of main outline segments, sets of stitch position data representative of respective stitch positions where the sewing needle penetrates the work sheet to form the series of stitches, the data producing apparatus including (a) means for specifying a set of secondary outline segment shape defining data defining a shape of each of the secondary outline segments such that the shape of the each secondary outline segment is different from a straight line segment, and (b) means for producing, based on the main outline segment data and the secondary outline segment shape defining data, the sets of stitch position data which are representative of respective stitch positions located on a stitch forming path alternately turning at the opposed main outline segments, the stitch forming path consisting of a plurality of path segments each of which connects between the main outline segments and has a shape influenced by the shapes of the secondary outline segments, and (B) a sewing machine including the sewing needle for forming the series of stitches by utilizing the sets of stitch position data produced by the data producing apparatus.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which:

FIG. 25 is a view for explaining the set of embroidery area data for the block pattern of FIG. 24;

DETAILED DESCRIPTION OF THE PREFERRED EMBODIMENTS

Figure 1:
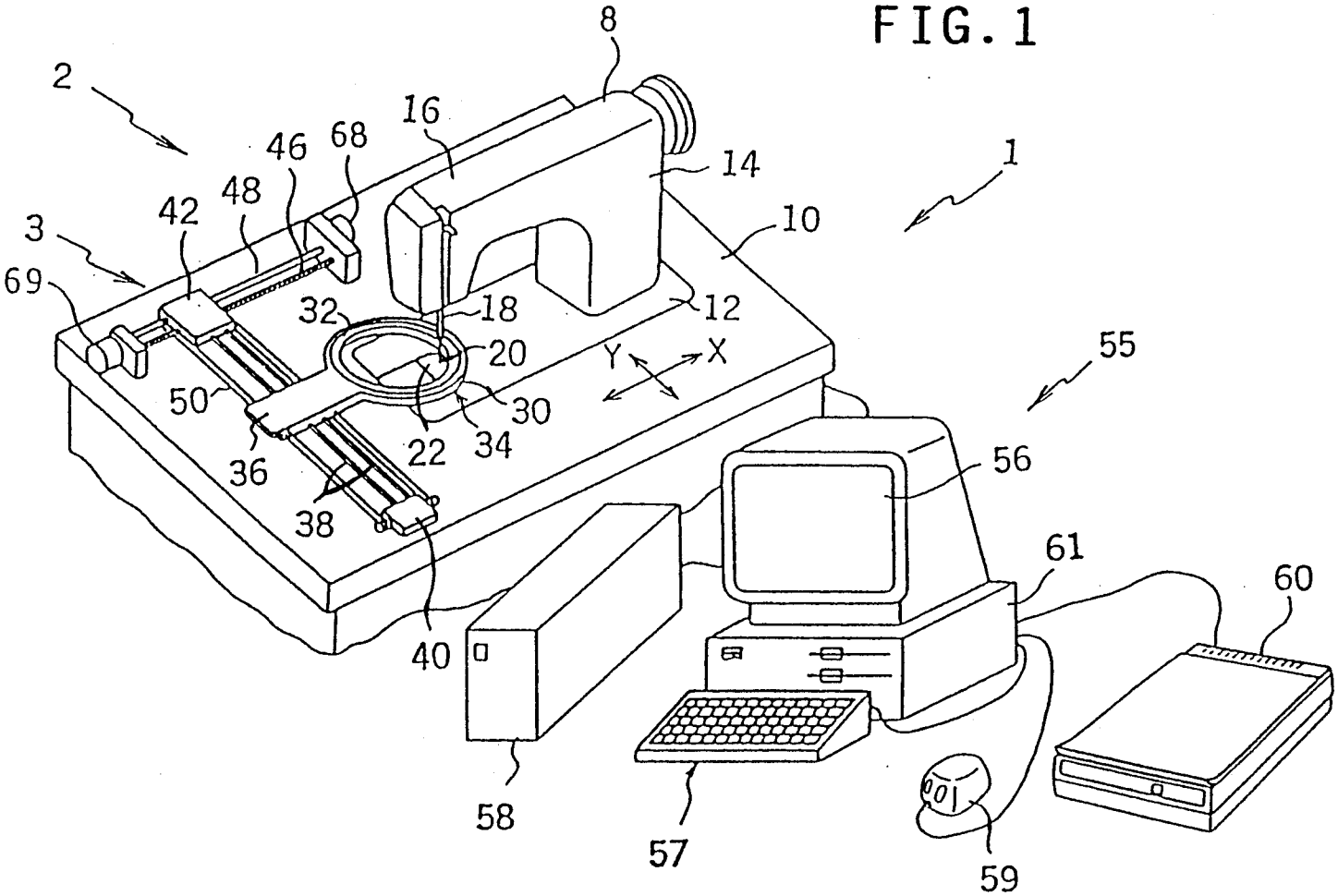
FIG. 1 is a perspective view of an embroidery sewing system to which the present invention is applied.

Referring to FIG. 1, there is shown an embroidery sewing system 1 to which the present invention is applied. The sewing system 1 produces embroidery data, i.e., stitch position data necessary for forming respective stitches in a block as an embroidery area or a part of an embroidery area, and forms the stitches to fill the block and thereby provide an embroidery.

The sewing system 1 is essentially constituted by an embroidery sewing machine 2 for forming an embroidery, and a data processing device 55. Hereunder, the sewing machine 2 will be described first by reference to FIG. 1.

On a machine table 10, there are provided a sewing head 8 and a work-fabric feed mechanism 3 for feeding a work fabric (not shown) in an X direction and in a Y direction perpendicular to the X direction. The sewing head 8 includes a column 14 extending vertically upward from a bed 12 supported by the table 10, and an arm 16 extending horizontally from the top of the column 14 above the bed 12, like a cantilever. The arm 16 accommodates a needle-bar drive mechanism (not shown) which is driven by a main motor 67 (FIG. 2) for vertically oscillating a needle bar 18. A sewing needle 20 is secured to the lower end of the needle bar 18. The bed 12 has an opening which is closed by a needle plate 22 having a needle hole through which the sewing needle 20 passes. Below the needle plate 22, is provided a loop taker (not shown) which cooperates with the sewing needle 20 to form, on the work fabric, individual stitches of an embroidery.

The work-fabric feed mechanism 3 includes an embroidery workholder 34 consisting of an annular outer frame 30 and an inner frame 32 which fits in the outer frame 30 to hold the work fabric. The feed mechanism 3 further includes a slide member 36 formed integrally with the outer frame 30 of the workholder 34. The slide member 36 is slidably supported by a pair of guide pipes 38, 38 extending in the Y direction, so that the slide member 36 is displaceable on the pipes 38, 38 in the Y direction. One end of each of the guide pipes 38, 38 is fixed to a first support member 40, and the other ends of the guide pipes 38, 38 are fixed to a second support member 42. The second support member 42 is threadedly engaged with a X-direction feed screw 46 extending in the X direction. A rotation transmit member 48 extends through the second support member 42. The X-direction feed screw 46 is driven or rotated by an X-direction feed motor 68 in a positive and a negative (or reverse) direction. Thus, when the X-direction feed motor 68 is driven, the X-direction feed screw 46 is rotated, so that the workholder 34 is moved in the X direction together with the first and second support members 40, 42 and the guide pipes 38, 38.

A pair of wire loops 50, 50 are provided each with suitable tension between the first and second support members 40, 42. The slide member 36 is fixed to appropriate portions of the wire loops 50, 50. Upon rotation of the rotation transmit member 48, the wire loops 50, 50 are displaced. One end of the rotation transmit member 48 is connected to a Y-direction feed motor 69. When the Y-direction feed motor 69 is driven, the rotation transmit member 48 is rotated and the wire loops 50 are displaced, so that the slide member 36 (and the workholder 34) is moved in the Y direction. Thus, by appropriately operating the X-direction and Y-direction feed motors 68, 69, the workholder 34 is moved to any desired position in an X-Y coordinate plane defined by the X and Y directions or axes. The feed mechanism 3 cooperates with the sewing head 8 to form individual stitches of an embroidery on the work fabric held by the outer and inner frames 30, 32 of the workholder 34. In the present embodiment, each of the feed motors 68, 69 is a stepper motor.

Next, the data processing device 55 will be described briefly. The processing device 55 includes a cathode ray tube (CRT) display 56, a keyboard 57, an external storage device 58 such as a hard-disk storage device, a coordinate data input device (e.g., mouse) 59, an image scanner 60 for reading in an image such as a character or a figure, and a control box 61 to which the peripheral devices 56, 57, 58, 59, 60 are connected. The control box 61 accommodates a control device 78 (described later) and a floppy disk drive (FDD) device 74 (FIG. 2).

Figure 2:
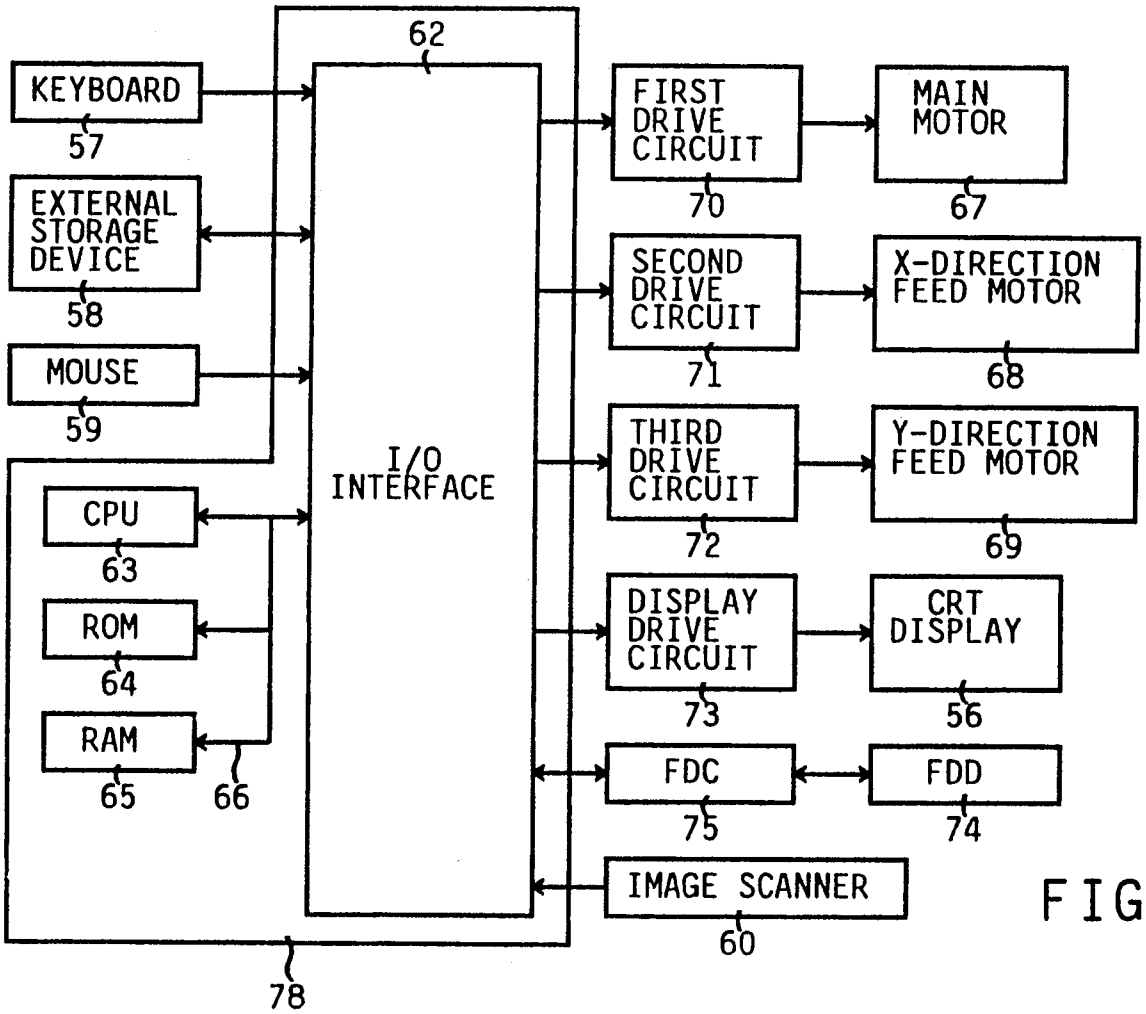
FIG. 2 is a diagrammatic view of the control circuit of the sewing system of FIG. 1.

FIG. 2 diagrammatically shows the control circuit of the embroidery sewing system 1 of FIG. 1.

The control device 78 includes an input and output (I/O) interface 62 to which are connected the keyboard 57, the storage device 58, the mouse 59, a display drive circuit 73 for the CRT display 56, a floppy disk controller (FDC) 75 for the FDD device 74, and the image scanner 60. In addition, a first drive circuit 70 for the main motor 67, a second drive circuit 71 for the X-direction feed motor 68, and a second drive circuit 72 for the Y-direction feed motor 69 are connected to the I/O interface 62.

The keyboard 57 has a number of keys for designating various embroidery patterns to be formed on a work fabric, such as alphabetic letters, numerals, and symbols, and additional keys for inputting various data such as stitch density data indicative of a number of stitches formed in unit distance. The external storage device 58 stores sets of pattern outline data each of which is representative of the outline of a corresponding one of a plurality of numbered embroidery patterns or areas, such as characters and figures, such that each set of pattern outline data is associated with stitch density data and is given a sequential number identical to that given to the corresponding one embroidery area. In the case where an embroidery area consists of a plurality of blocks such as quadrangles, the set of pattern outline data for the embroidery area includes sets of position data indicative of the positions of both ends (i.e., start and end points) of each of the outline segments which cooperate with each other to define the outline of each of the blocks, and data for defining the shape (e.g., straight, polygonal, or curve) of that each line segment (hereinafter, referred to as the "shape data").

The control device 78 is essentially constituted by a central processing unit (CPU) 63, and a read only memory (ROM) 64, a random access memory (RAM) 65 and the I/O interface 62 which are connected via data bus 66 to the CPU 63. The ROM 64 stores various control programs including an embroidery data production program (described later). The RAM 65 includes an image data memory for storing image data representative of an image read in by the image scanner 60, an outline data memory for storing pattern outline data read from the external storage device 58, a stitch density memory for storing stitch density data inputted by operating the keyboard 57 or read from the storage device 58, and a working memory. The RAM 65 further includes various memories, counters and pointers for temporarily storing the results of calculation of the CPU 63.

FIGS. 3 through 9 and 11 through 13 show various block patterns, BP1 through BP10. An embroidery area to be filled with stitches may consist of either a single block pattern BP or a plurality of identical or different block patterns BP.

Hereunder, there will be described the process of determining stitch positions at which the sewing needle 20 penetrates the work fabric held by the workholder 34 so as to form respective stitches and thereby fill each of the block patterns BP1 to BP10.

The stitch positions of each of the block patterns BP are determined based on a set of pattern outline data representative of the outline of the each block pattern BP (hereunder, referred to as the "basic data"). Each set of basic data includes sets of position data representative of the positions of defining points located on the outline of a corresponding one of the block patterns BP, and sets of shape data for defining the shapes (e.g., straight, polygonal, or curve) of the outline segments between pairs of adjacent two points out of the above defining points. In the present embodiment, a set of basic data includes four sets of position data for four defining points located on an outline of a block pattern, and four sets of shape data for defining the shapes of four outline segments between the four defining points. Thus, the outline of each block pattern BP consists of a pair of opposed main segments and a pair of opposed secondary segments. Each set of basic data may further include at least one set of position data representative of at least one aid point located on each of the two secondary segments, and/or include at least one set of position data representative of at least one aid point located on each of the two main segments. The two main segments are represented by main segment data including the four sets of position data for the four defining points (i.e., both end points of each of the two main segments), the two sets of shape data for defining the shapes of the two main segments, and optionally the at least two sets of position data for the at least two aid points located on the two main segments. On the other hand, the two secondary segments are represented by secondary segment data including the two sets of shape data for defining the shapes of the two secondary segments, and optionally the at least two sets of position data for the at least two aid points located on the two secondary segments. The first block pattern BP1 has no aid point on the secondary segments thereof and therefore the basic data therefor includes no position data for such aid point.

Figure 3:
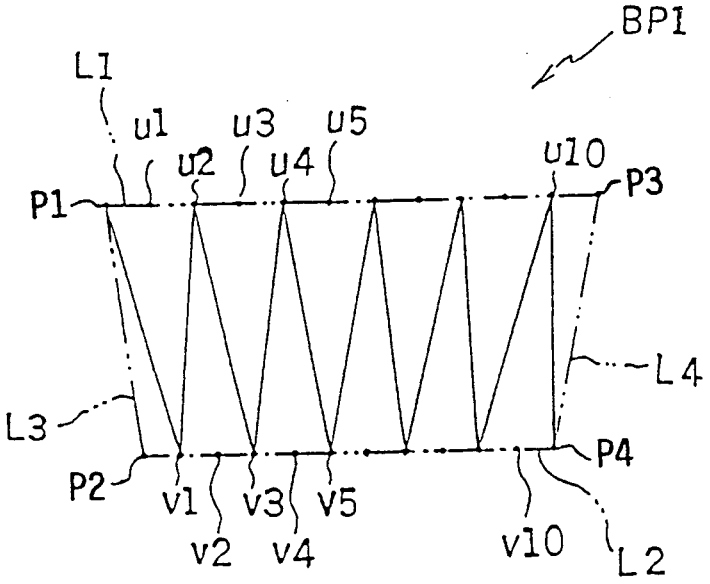
FIG. 3 is a view of a first block pattern BP1 as an example of an embroidery area having a pair of main segments each defined by a straight line segment and a pair of secondary segments each defined by a straight line segment, and respective stitches formed in the block pattern BP1.

A. First Block Pattern BP1 (FIG. 3)

1) Basic Data

The basic data for the first block pattern BP1 includes four sets of coordinate data indicative of the coordinate positions of four defining points, P1 to P4, and four sets of shape data specifying that a first main segment, L1, between the first and third defining points P1, P3, a second main segment, L2, between the second and fourth defining points P2, P4, a first secondary segment, L3, between the first and second defining points P1, P2, and a second secondary segment, L4, between the third and fourth defining points P2, P4, each are a straight line segment.

2) Determination of Main Segments L1, L2

The first main segment L1 is determined by connecting between the first and third defining points P1, P3 by a straight line segment, and the second main segment L2 is determined by connecting between the second and fourth defining points P2, P4 by a straight line segment.

3) Determination of Secondary Segments L3, L4

The first secondary segment L3 is determined by connecting between the first and second defining points P1, P2 by a straight line segment, and the second secondary segment L4 is determined by connecting between the third and fourth defining points P3, P4 by a straight line segment.

4) Determination of Aid Main Segment

No aid main segment is determined.

5) Determination of Stitch Positions

1. A straight line segment connecting between the midpoint of the first secondary segment L3 and the midpoint of the second secondary segment L4, is divided by a stitch pitch (i.e., regular interval of distance between each pair of adjacent two stitches) defined by stitch density data for the first block pattern BP1, so as to obtain a division number M.

2. The first main segment L1 is divided by the division number M to determine respective division points u2, u2, u3, . . . such that, starting from the first defining point P1, the points P1, u1, u2, u3, . . . are equidistant from each other on the main segment L1.

3. The second main segment L2 is divided by the division number M to determine respective division points v1, v2, v3, . . . such that, starting from the second defining point P2, the points v1, v2, v3, . . . , P4 are equidistant from each other on the main segment L2.

4. The first defining point P1, odd-number division points v1, v3, . . . on the second main segment L2, even-number division points u2, u4, . . . on the first main segment L1, and the fourth defining point P4 are determined in sequence as stitch positions for forming a "V-shape stitch" embroidery in the first block pattern BP1. Specifically, the points P1, v1, u2, v3, u4, . . . , P4 are determined as stitch positions in the order of description.

Figure 4:
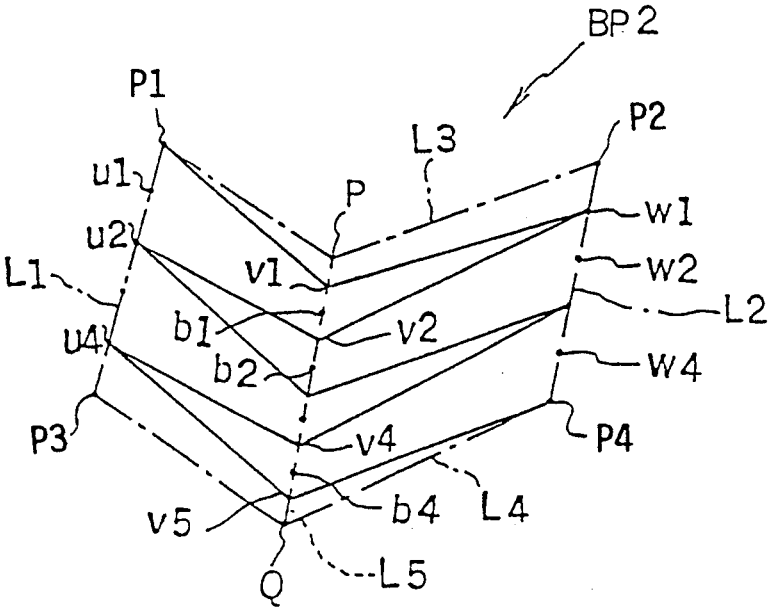
FIG. 4 is a view of a second block pattern BP2 as an example of an embroidery area having a pair of main segments each defined by a straight line segment, a pair of secondary segments each defined by a polygonal line, and an aid main segment defined by a straight line segment, and respective stitches formed in the block pattern BP2.

B. Second Block Pattern BP2 (FIG. 4)

1) Basic Data

The basic data for the second block pattern BP2 includes six sets of coordinate data indicative of the coordinate positions of four defining points P1 to P4 and two aid points, P and Q, respectively located on the two secondary segments L3, L4, and five sets of shape data specifying that the two main segments L1, L2 and an aid main segment, L5, connecting between the two aid points P, Q each are a straight line segment and specifying that the two secondary segments L3, L4 each are a polygonal (or bent) segment. The aid points P, Q are the vertices (or points of bending) of the polygonal lines L3, L4, respectively.

2) Determination of Main Segments L1, L2

The first main segment L1 is determined by connecting between the first and third defining points P1, P3 by a straight line segment, and the second main segment L2 is determined by connecting between the second and fourth defining points P2, P4 by a straight line segment.

3) Determination of Secondary Segments L3, L4

The first secondary segment L3 is determined by connecting between the first and second defining points P1, P2 through the aid point P by two straight line segments (i.e., polygonal line segment). The second secondary segment L4 is determined by connecting between the third and fourth defining points P3, P4 through the aid point Q by two straight line segments (i.e., polygonal line segment).

4) Determination of Aid Main Segment L5

The aid main segment L5 is determined by connecting between the aid points P, Q by a straight line segment.

5) Determination of Stitch Positions

1. The aid main segment L5 is divided by a stitch pitch defined by stitch density data for the second block pattern BP2, so as to obtain a division number M.

2. The first main segment L1 is divided by the division number M to determine respective division points u1, u2, u3, . . . such that, starting from the first defining point P1, the points P1, u1, u2, u3, . . . are equidistant from each other on the main segment L1.

3. The second main segment L2 is divided by the division number M to determine respective division points w1, w2, w3, . . . such that, starting from the second defining point P2, the points w1, w2, w3, . . . , P4 are equidistant from each other on the main segment L2.

4. The aid main segment L5 is divided by the division number M to determine respective division points b1, b2, b3, . . . such that, starting from the aid point P, the points P, b1, b2, b3, . . . , Q are equidistant from each other on the aid main segment L5.

5. Assuming that the length of the line segment between the points P1 and P be equal to that of the line segment between the points P and P2 and that the length of the line segment between the points P3 and Q be equal to that of the line segment between the points Q and P4, intermediate division points v1, v2, v3, . . . are determined at the midpoint of each of the line segments between pairs of adjacent two points out of the points P, b1, b2, b3, . . . , Q on the aid main segment L5. However, it is possible to determine the intermediate division points v1, v2, v3, . . . based on a ratio of the length of the line segment between the points P1 and P to that of the line segment between the points P and P2 and a ratio of the length of the line segment between the points Q and P4 to that of the line segment between the points P3 and Q.

6. The first defining point P1, odd-number division points v1, v3, . . . on the aid main segment L5, odd-number division points w1, w3, . . . on the second main segment L2, even-number division points v2, v4, . . . on the aid main segment L5, even-number division points u2, u4, . . . on the first main segment L1, and the fourth defining point P4 are determined in sequence as stitch positions. Specifically, the points P1, v1, w1, v2, u2, v3, w3, v4, u4, . . . , P4 are determined as stitch positions in the order of description.

Figure 5:
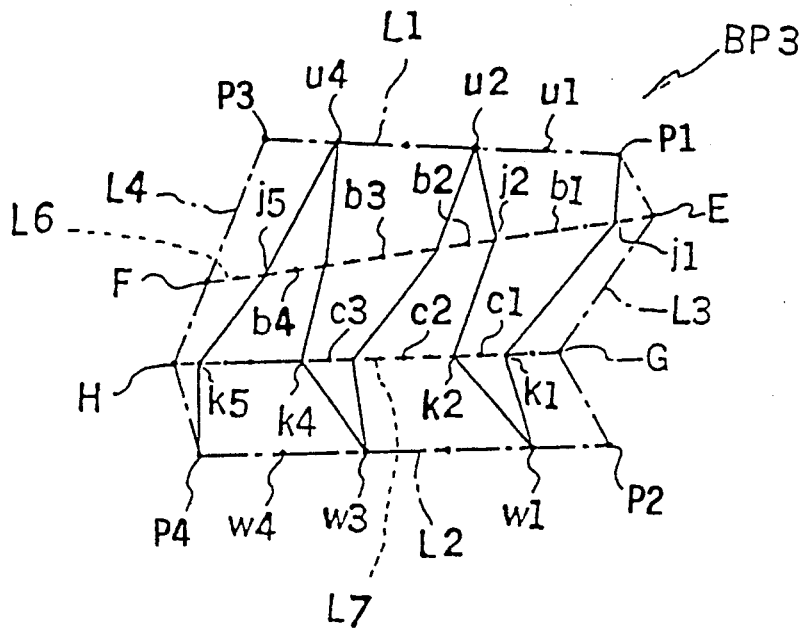
FIG. 5 is a view of a third block pattern BP3 as an example of an embroidery area having a pair of main segments each defined by a straight line segment, a pair of secondary segments each defined by a polygonal line, and a pair of aid main segments each defined by a straight line segment, and respective stitches formed in the block pattern BP3.

C. Third Block Pattern BP3 (FIG. 5)

1) Basic Data

The basic data for the third block pattern BP3 includes eight sets of coordinate data indicative of the coordinate positions of four defining points P1 to P4, two aid points, E and G, located on the first secondary segment L3, and two aid points, F and H, located on the second secondary segment L4; and six sets of shape data specifying that the two main segments L1, L2, a first aid main segment, L6, connecting between the aid points E, F, and a second aid main segment, L7, connecting between the aid points G, H each are a straight line segment and specifying that the two secondary segments L3, L4 each are a polygonal line segment. The aid points E, G are the vertices of the polygonal line L3, and the aid points F, H are the vertices of the polygonal line L4. The aid point F satisfies the condition that a ratio of the length of the line segment between the points P1 and E to that of the line segment between the points E and G is equal to a ratio of the length of the line segment between the points F and H to that of the line segment between the points P3 and F.

2) Determination of Main Segments L1, L2

The first main segment L1 is determined by connecting between the first and third defining points P1, P3 by a straight line segment, and the second main segment L2 is determined by connecting between the second and fourth defining points P2, P4 by a straight line segment.

3) Determination of Secondary Segments L3, L4

The first secondary segment L3 is determined by connecting between the first and second defining points P1, P2 through the two aid points E, G by three straight line segments (i.e., polygonal line segment), and the second secondary segment L4 is determined by connecting between the third and fourth defining points P3, P4 through the two aid points F, H by three straight line segments (i.e., polygonal line segment).

4) Determination of Aid Main Segments L6, L7

The first aid main segment L6 is determined by connecting between the aid points E, G by a straight line segment, and the second aid main segment L7 is determined by connecting between the aid points F, H by a straight line segment.

5) Determination of Stitch Positions

1. An average value of the lengths of the first and second aid main segments L6, L7 is divided by a stitch pitch defined by stitch density data for the third block pattern BP3, so as to obtain a division number M.

2. The first main segment L1 is divided by the division number M to determine respective division points u1, u2, u3, . . . such that, starting from the first defining point P1, the points P1, u1, u2, u3, . . . are equidistant from each other on the main segment L1.

3. The second main segment L2 is divided by the division number M to determine respective division points w1, w2, w3, . . . such that, starting from the second defining point P2, the points w1, w2, w3, . . . , P4 are equidistant from each other on the main segment L2.

4. The first aid main segment L6 is divided by the division number M to determine respective division points b1, b2, b3, . . . such that, starting from the aid point E, the points E, b1, b2, b3, . . . , F are equidistant from each other on the first aid main segment L6.

5. The second aid main segment L7 is divided by the division number M to determine respective division points c1, c2, c3, . . . such that, starting from the aid point G, the points G, c1, c2, c3, . . . , H are equidistant from each other on the second aid main segment L7.

6. Assuming that the lengths of the six line segments between the points P1 and E, between the points E and G, between the points G and P2, between the points P3 and F, between the points F and H, and between the points H and P4 be equal to each other, a $\frac{1}{3}$ and a $\frac{2}{3}$ internally dividing point of each of the line segments between pairs of adjacent two points out of the points E, b1, b2, b3, . . . , F are determined on the first aid main segment L6, and the $\frac{1}{3}$ dividing points and the $\frac{2}{3}$ dividing points are alternately selected as intermediate division points j1, j2, j3, . . . from the $\frac{1}{3}$ and $\frac{2}{3}$ dividing points of the respective line segments on the first aid main segment L6. Similarly, on the second aid main segment L7, are determined a $\frac{1}{3}$ and a $\frac{2}{3}$ internally dividing point of each of the line segments between pairs of adjacent two points out of the points G, c1, c2, c3, . . . , H. However, differently, the $\frac{2}{3}$ dividing points and the $\frac{1}{3}$ dividing points are alternately selected as intermediate division points k1, k2, k3, . . . from the $\frac{1}{3}$ and $\frac{2}{3}$ dividing points of the respective line segments on the second aid main segment L7. However, it is possible to determine the intermediate points j1, j2, j3, . . . based on a ratio of the length of the line segment between the points P1 and E to that of the line segment between the points E and G and a ratio of the length of the line segment between the points F and H to that of the line segment between the points P3 and F, and determine the intermediate points k1, k2, k3, . . . based on a ratio of the length of the line segment between the points E and G to that of the line segment between the points G and P2 and a ratio of the length of the line segment between the points H and P4 to that of the line segment between the points F and H.

6. The first defining point P1, odd-number division points j1, j3, . . . on the first aid main segment L6, odd-number division points k1, k3, . . . on the second aid main segment L7, odd-number division points w1, w3, . . . on the second main segment L2, even-number division points k2, k4, . . . on the second aid main segment L7, even-number division points j2, j4, . . . on the first aid main segment L6, even-number division points u2, u4, . . . on the first main segment L1, and the fourth defining point P4 are determined in sequence as stitch positions. Specifically, the points P1, j1, k1, w1, k2, j2, u2, j3, k3, w3, . . . , P4 are determined as stitch positions in the order of description.

Figure 6:
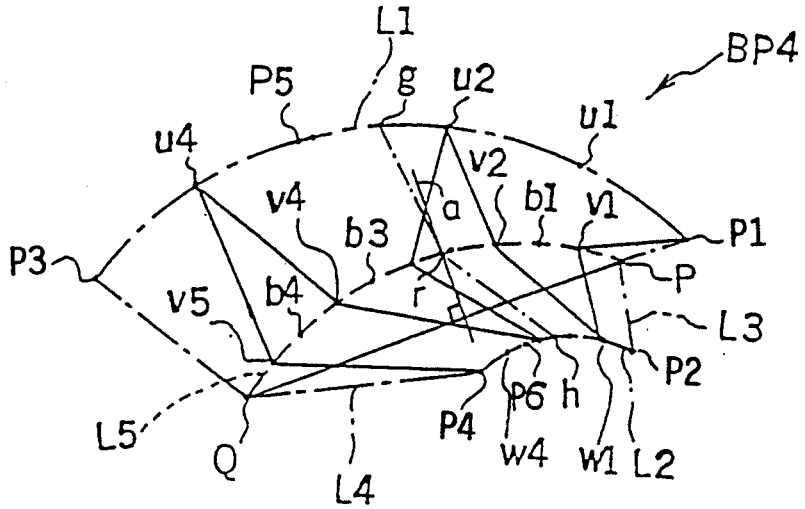
FIG. 6 is a view of a fourth block pattern BP4 as an example of an embroidery area having a pair of main segments each defined by a circular arc, a pair of secondary segments each defined by a polygonal line, and an aid main segment defined by a circular arc, and respective stitches formed in the block pattern BP4.

D. Fourth Block Pattern BP4 (FIG. 6)

1) Basic Data

The basic data for the fourth block pattern BP4 includes eight sets of coordinate data indicative of the coordinate positions of four defining points P1 to P4, two aid points, P5 and P6, respectively located on the two main segments L1, L2, and two aid points P and Q, respectively located on the two secondary segments L3, L4; and five sets of shape data specifying that the two main segments L1, L2 and an aid main segment L5 connecting between the aid points P, Q each are a circular arc and specifying that the two secondary segments L3, L4 each are a polygonal line segment. The aid points P, Q are the vertices of the polygonal lines L3, L4, respectively, and satisfy the conditions that the length of the line segment between the points P1 and P is equal to that of the line segment between the points P and P2 and that the length of the line segment between the points P3 and Q is equal to that of the line segment between the points Q and P4.

2) Determination of Main Segments L1, L2

The first main segment L1 is determined by connecting between the first and third defining points P1, P3 through the aid point P5 by a circular arc, and the second main segment L2 is determined by connecting between the second and fourth defining points P2, P4 through the aid point P6 by a circular arc.

3) Determination of Secondary Segments L3, L4

The first secondary segment L3 is determined by connecting between the first and second defining points P1, P2 through the aid point P by two straight line segments (i.e., polygonal line segment), and the second secondary segment L4 is determined by connecting between the third and fourth defining points P3, P4 through the aid point Q by two straight line segments (i.e., polygonal line segment).

4). Determination of Aid Main Segment L5

1. A point, g, is located at the midpoint of the girth length of the first main segment L1, and a point, h, is located at the midpoint of the girth length of the second main segment L2. A girth length means the length of a curve (or curved line segment) as measured along the trace of the curve itself.

2. A point, r, is located on a straight line, a, perpendicular to the midpoint of the line segment between the aid points P, Q, such that the distance between the points g, r is equal to the distance between the points r, h. However, it is possible to locate the point r such that the point r satisfies the conditions that the distance between the points P, r is equal to the distance between the points r, Q and that a ratio of the distance between the points r, h to the distance between the points g, r is equal to half the sum of a ratio of the length of the line segment between the points P, P2 to that of the line segment between the points P1, P and a ratio of the length of the line segment between the points Q, P4 to that of the line segment between the points P3, Q.

3. The aid main segment L5 is determined by connecting between the aid points P, Q through the point r by a circular arc.

5) Determination of Stitch Positions

1. The length of the aid main segment L5 is divided by a stitch pitch defined by stitch density data for the fourth block pattern BP4, so as to obtain a division number M.

2. The first main segment L1 is divided by the division number M to determine respective division points u1, u2, u3, . . . such that, starting from the first defining point P1, the points P1, u1, u2, u3, . . . are equidistant from each other on the first main segment L1.

3. The second main segment L2 is divided by the division number M to determine respective division points w1, w2, w3, . . . such that, starting from the second defining point P2, the points w1, w2, w3, . . . , P4 are equidistant from each other on the second main segment L2.

4. The aid main segment L5 is divided by the division number M to determine respective division points b1, b2, b3, . . . such that, starting from the aid point P, the points P, b1, b2, b3, . . . , Q are equidistant from each other on the aid main segment L5. Assuming that the length of the line segment between the points P1 and P be equal to that of the line segment between the points P and P2 and that the the length of the line segment between the points P3 and Q be equal to that of the line segment between the points Q and P4, intermediate division points v1, v2, v3, . . . are located at the midpoint of each of the line segments between pairs of adjacent two points out of the points P, b1, b2, b3, . . . , Q on the aid main segment L5. However, it is possible to locate the intermediate division points v1, v2, v3, . . . based on a ratio of the length of the line segment between the points P1 and P to that of the line segment between the points P and P2 and a ratio of the length of the line segment between the points Q and P4 to that of the line segment between the points P3 and Q.

5. The first defining point P1, odd-number division points v1, v3, . . . on the aid main segment L5, odd-number division points w1, w3, . . . on the second main segment L2, even-number division points v2, v4, . . . on the aid main segment L5, even-number division points u2, u4, . . . on the first main segment L1, and the fourth defining point P4 are determined in sequence as stitch positions. Specifically, the points P1, v1, w1, v2, u2, v3, w3, v4, u4, . . . , P4 are determined as stitch positions in the order of description.

Figure 7:
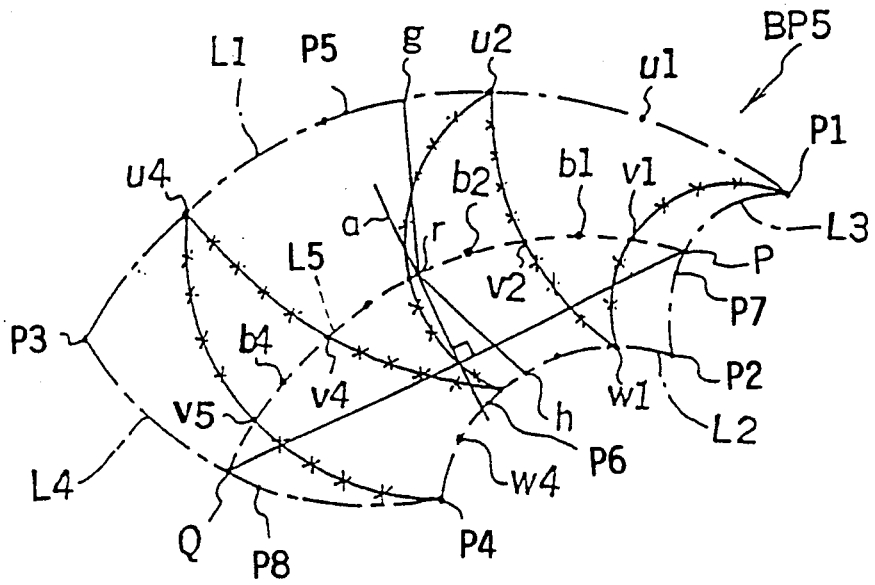
FIG. 7 is a view of a fifth block pattern BP5 as an example of an embroidery area having a pair of main segments each defined by a circular arc, a pair of secondary segments each defined by a circular arc, and an aid main segment defined by a circular arc, and respective stitches formed in the block pattern BP5.

E. Fifth Block Pattern BP5 (FIG. 7)

1) Basic Data

The basic data for the fifth block pattern BP5 includes eight sets of coordinate data indicative of the coordinate positions of four defining points P1 to P4, two aid points P5 and P6 respectively located on the two main segments L1, L2, and two aid points, P7 and P8, respectively located on the two secondary segments L3, L4; and five sets of shape data specifying that the two main segments L1, L2, an aid main segment L5, and the two secondary segments L3, L4 each are defined by a circular arc.

2) Determination of Main Segments L1, L2

The first main segment L1 is determined by connecting between the first and third defining points P1, P3 through the aid point P5 by a circular arc, and the second main segment L2 is determined by connecting between the second and fourth defining points P2, P4 through the aid point P6 by a circular arc.

3) Determination of Secondary Segments L3, L4

The first secondary segment L3 is determined by connecting between the first and second defining points P1, P2 through the aid point P7 by a circular arc, and the second secondary segment L4 is determined by connecting between the third and fourth defining points P3, P4 through the aid point P8 by a circular arc.

4) Determination of Aid Main Segment L5

1. As described with respect to the fourth block pattern BP4, a point g is located at the midpoint of the first main segment L1, and a point h is located at the midpoint of the second main segment L2. In addition, a point, P, is located at the midpoint of the girth length of the first secondary segment L3, and a point, Q, is located at the midpoint of the girth length of the second secondary segment L4.

2. As described with respect to the fourth block pattern BP4, a point r is located on a straight line perpendicular to the midpoint of the line segment between the points P, Q.

3. As described with respect to the fourth block pattern BP4, the aid main segment L5 is determined by connecting between the points P, Q through the point r by a circular arc.

5) Determination of Stitch Positions

1. As described with respect to the fourth block pattern BP4, division points u1, u2, u3, . . . are determined on the first main segment L1 such that, starting from the first defining point P1, the points P1, u1, u2, u3, . . . are equidistant from each other; division points w1, w2, w3, . . . are determined on the second main segment L2 such that, starting from the second defining point P2, the points w1, w2, w3, P4 are equidistant from each other; and division points b1, b2, b3, . . . are determined on the aid main segment L5 such that, starting from the point P, the points P, b1, b2, b3, Q are equidistant from each other, and intermediate division points v1, v2, v3, . . . are located at the midpoint of each of the line segments between pairs of adjacent two points out of the points P, b1, b2, b3, . . . , Q on the aid main segment L5.

2. A circular arc is determined which connects between the first defining point Pl and the division point w1 through the intermediate division point v1, and aid stitch positions are located on that circular arc at a pre-selected stitch pitch as indicated at symbols "x" in FIG. 7. Thus, the first defining point P1, aid stitch positions, intermediate division point v1, aid stitch positions, and division point w1 are determined as stitch positions in the order of description. Subsequently, a circular arc is determined which connects between the division point w1 and the division point u2 through the intermediate division point v2, and aid stitch positions are determined on that circular arc at the pre-selected stitch pitch. Thus, the aid stitch positions, intermediate division point v2, aid stitch positions, and division point u2 are determined as stitch positions in the order of description. Then, similar operations are repeated, so that stitch positions are determined in sequence up to the fourth defining point P4.

Figure 8:
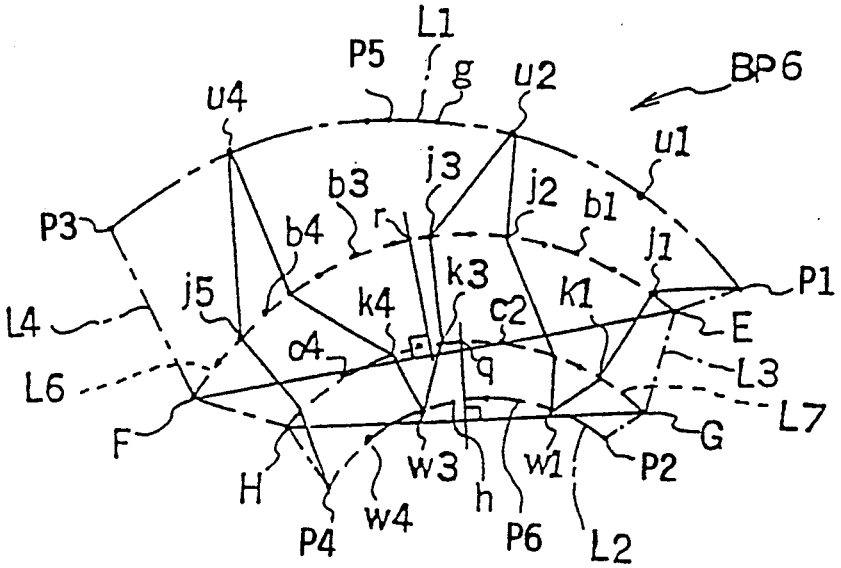
FIG. 8 is a view of a sixth block pattern BP6 as an example of an embroidery area having a pair of main segments each defined by a circular arc, a pair of secondary segments each defined by a polygonal line, and a pair of aid main segments each defined by a circular arc, and respective stitches formed in the block pattern BP6.

F. Sixth Block Pattern BP6 (FIG. 8)

1) Basic Data

The basic data for the sixth block pattern BP6 includes ten sets of coordinate data indicative of the coordinate positions of four defining points P1 to P4, two aid points P5 and P6, respectively located on the two main segments L1, L2, two aid points E and G located on the first secondary segment L3, and two aid points F and H located on the second secondary segment L4; and six sets of shape data specifying that the two main segments L1, L2, a first aid main segment L6 connecting between the aid points E, F, and a second aid main segment L7 connecting between the aid points G, H each are a circular arc and specifying that the two secondary segments L3, L4 each are a polygonal segment. The aid points E, G are the vertices of the polygonal line L3, and the aid points F, H are the vertices of the polygonal line L4.

2) Determination of Main Segments L1, L2

The first main segment L1 is determined by connecting between the first and third defining points P1, P3 through the aid point P5 by a circular arc, and the second main segment L2 is determined by connecting between the second and fourth defining points P2, P4 through the aid point P6 by a circular arc.

3) Determination of Secondary Segments L3, L4

The first secondary segment (polygonal line) L3 is determined by connecting between the first and second defining points P1, P2 through the two aid points E, G by three straight line segments, and the second secondary segment (polygonal line) L4 is determined by connecting between the third and fourth defining points P3, P4 through the two aid points F, H by three straight line segments.

4) Determination of Aid Main Segments L7, L8

1. As described with respect to the fourth block pattern BP4, a point g is located at the midpoint of the first main segment L1, and a point h is located at the midpoint of the second main segment L2.

2. As described with respect to the fourth block pattern BP4, a point r is located on a straight line perpendicular to the midpoint of the line segment between the aid points E, F, and a point, q, is located on a straight line perpendicular to the midpoint of the line segment between the aid points G, H.

3. As described with respect to the fourth block pattern BP4, the first aid main segment L6 is determined by connecting between the aid points E, F through the point r by a circular arc, and the second aid main segment L7 is determined by connecting between the aid points G, H through the point q by a circular arc.

5) Determination of Stitch Positions

1. As described with respect to the third block pattern BP3, division points u1, u2, u3, . . . are determined on the first main segment L1, starting from the first defining point P1, such that the points P1, u1, u2, u3, . . . are equidistant from each other; division points w1, w2, w3, . . . are determined on the second main segment L2 such that, starting from the second defining point P2, the points w1, w2, w3, . . . , P4 are equidistant from each other; division points b1, b2, b3, . . . are determined on the first aid main segment L6 such that, starting from the aid point E, the points E, b1, b2, b3, F are equidistant from each other, and intermediate division points j1, j2, j3, . . . are located at the $\frac{1}{3}$ or $\frac{2}{3}$ internally dividing point of each of the line segments between pairs of adjacent two points out of the points E, b1, b2, b3, . . . , F on the first aid main segment L6; and division points c1, c2, c3, . . . are determined on the second aid main segment L7 such that, starting from the aid point G, the points G, c1, c2, c3, . . . , H are equidistant from each other, and intermediate division points k1, k2, k3, . . . are located at the $\frac{1}{3}$ or $\frac{2}{3}$ internally dividing point of each of the line segments between pairs of adjacent two points out of the points G. c1, c2, c3, . . . , H on the second aid main segment L7. However, it is possible to determine the intermediate points j1, j2, j3, . . . based on a ratio of the length of the line segment between the points P1 and E to that of the line segment between the points E and G and a ratio of the length of the line segment between the points F and H to that of the line segment between the points P3 and F, and determine the intermediate points k1, k2, k3, . . . based on a ratio of the length of the line segment between the points E and G to that of the line segment between the points G and P2 and a ratio of the length of the line segment between the points H and P4 to that of the line segment between the points F and H.

2. The first defining point P1, odd-number intermediate division points j1, j3, . . . on the first aid main segment L6, odd-number intermediate division points k1, k3, . . . on the second aid main segment L7, odd-number division points w1, w3, . . . on the second main segment L2, even-number intermediate division points k2, k4, . . . on the second aid main segment L7, even-number intermediate division points j2, j4, . . . on the first aid main segment L6, even-number division points u2, u4, . . . on the first main segment L1, . . . and the fourth defining point P4 are determined in sequence as stitch positions. Specifically, the points P1, j1, k1, w1, k2, j2, u2, j3, k3, w3, . . . , P4 are determined as stitch positions in the order of description.

Figure 9:
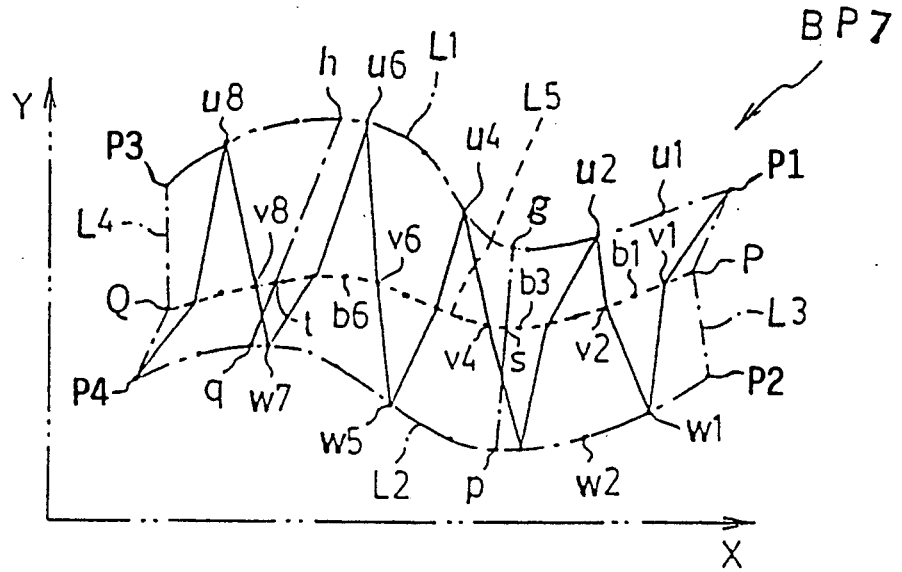
FIG. 9 is a view of a seventh block pattern BP7 as an example of an embroidery area having a pair of main segments each defined by a spline curve, a pair of secondary segments each defined by a polygonal line, and an aid main segment defined by a spline curve, and respective stitches formed in the block pattern BP7.

G. Seventh Block Pattern BP7 (FIG. 9)

1) Basic Data

The basic data for the seventh block pattern BP7 includes ten sets of coordinate data indicative of the coordinate positions of four defining points P1 to P4, two aid points, g and h, located on the first main segment L1, two aid points, p and q, located on the second main segment L2, and two aid points P and Q, respectively located on the two secondary segments L3, L4; and five sets of shape data specifying that the two main segments L1, L2 and an aid main segment L5 connecting between the aid points P, Q each are defined by a spline curve (a free-form curve) and specifying that the two secondary segments L3, L4 each are defined by a polygonal line. The aid points g, h have the smallest and greatest Y coordinates of all the points on the first main segment L1, respectively, and the aid points p, q have the smallest and greatest Y coordinates of all the points on the second main segment L2, respectively.

2) Determination of Main Segments L1, L2

The first main segment L1 is determined by connecting between the first and third defining points P1, P3 through the two aid points g, h by a spline curve. Stated differently, the spline curve L1 is determined by replacing variables in a pre-selected function equation with the coordinates of the points P1, P3, g, h. Similarly, the second main segment L2 is determined by connecting between the second and fourth defining points P2, P4 through the two aid points p, q by a spline curve.

3) Determination of Secondary Segments L3, L4

The first secondary segment (polygonal line) L3 is determined by connecting between the first and second defining points P1, P2 through the aid point P by two straight line segments, and the second secondary segment (polygonal line) L4 is determined by connecting between the third and fourth defining points P3, P4 through the aid point Q by two straight line segments.

4) Determination of Aid Main Segment L5

Figure 10:
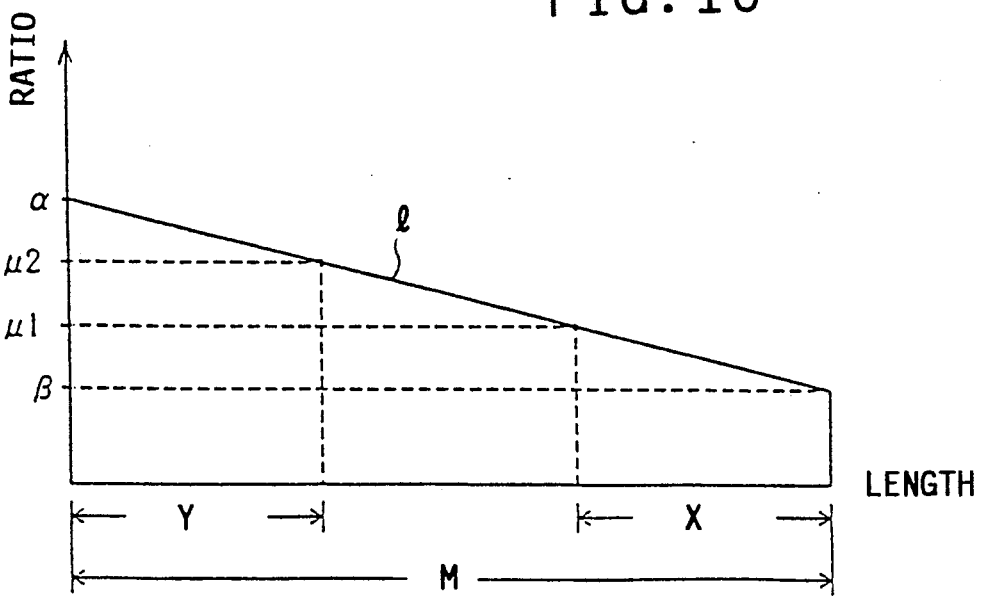
FIG. 10 is a graph for explaining the manner to locate two aid points s, t for determining a spline curve defining the aid main segment in the seventh block pattern BP7 such that the aid main segment is influenced by the shapes of the two main segments.

1. Providing that a value, $\alpha$, is the ratio of the length of the line segment between the points P3, Q to the sum of the length of the line segment between the points P3, Q and the length of the line segment between the points Q, P4; a value, $\beta$, is the ratio of the length of the line segment between the points P1, P to the sum of the length of the line segment between the points P1, P and the length of the line segment between the points P, P2; and a value, m, is the average value of the girth lengths of the two main segments L1, L2, a "ratio" function is determined which is represented by a straight line, l, as shown in FIG. 10.

2. By utilizing the "ratio" function l, is determined a ratio, $\mu 1$, corresponding to the average value, X, of the girth length of the spline curve segment between the points P1, g and the girth length of the spline curve segment between the points P2, p, and is determined a ratio, $\mu 2$, corresponding to the average value, Y, of the girth length of the spline curve segment between the points h, 3P and the girth length of the spline curve segment between the points q, P4.

3. A point, s, is located on a straight line segment connecting between the points g, p such that the ratio of the length of the line segment between the points g, s to that of the line segment between the points g, p is equal to the ratio $\mu 1$, and a point, t, is located on a straight line segment connecting between the points h, q such that the ratio of the length of the line segment between the points h, t to that of the line segment between the points h, q is equal to the ratio $\mu 2$.

4. The aid main segment L5 is determined by connecting between the points P, Q through the two points s, t by a spline curve. Stated differently, the spline curve L5 is determined by replacing variables in the preselected function equation with the coordinates of the points P, Q, s, t.

5) Determination of Stitch Positions

1. The aid main segment L5 is divided by a stitch pitch defined by stitch density data for the seventh block pattern BP7, so as to obtain a division number M.

2. The first main segment L1 is divided by the division number M to determine respective division points u1, u2, u3, . . . such that, starting from the first defining point P1 such that the points P1, u1, u2, u3, . . . are equidistant from each other on the first main segment L1.

3. The second main segment L2 is divided by the division number M to determine respective division points w1, w2, w3, . . . such that, starting from the second defining point P2, the points w1, w2, w3, . . . , P4 are equidistant from each other on the second main segment L2.

4. The aid main segment L5 is divided by the division number M to determine respective division points b1, b2, b3, . . . such that, starting from the aid point P, the points P, b1, b2, b3, . . . , Q are equidistant from each other on the aid main segment L5. In addition, based on the shapes of the two secondary segments L3, L4, intermediate division points v1, v2, v3, . . . are determined on each of the line segments between pairs of adjacent two points out of the points P, b1, b2, b3, . . . , Q on the aid main segment L5. For example, it is possible to determine the intermediate division points v1, v2, v3, . . . based on a ratio of the length of the line segment between the points P1 and P to that of the line segment between the points P and P2 and a ratio of the length of the line segment between the points Q and P4 to that of the line segment between the points P3 and Q.

5. The first defining point P1, odd-number intermediate division points v1, v3, . . . on the aid main segment L5, odd-number division points w1, w3, . . . on the second main segment L2, even-number intermediate division points v2, v4, . . . on the aid main segment L5, even-number division points u2, u4, . . . on the first main segment L1, and the fourth defining point P4 are determined in sequence as stitch positions. Specifically, the points P1, v1, w1, v2, u2, v3, w3, v4, u4, . . . , P4 are determined as stitch positions in the order of description.

Figure 11:
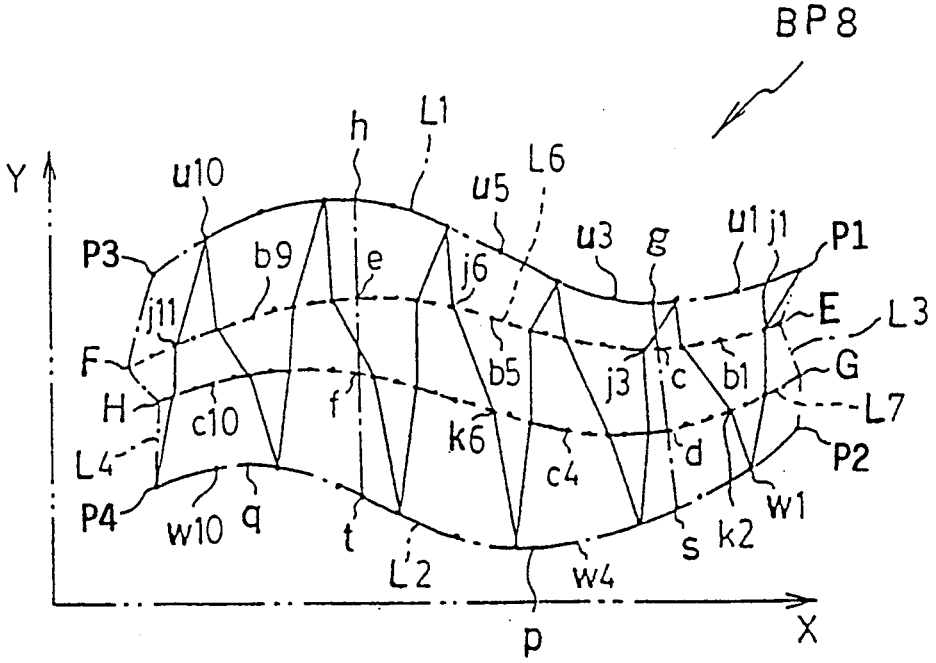
FIG. 11 is a view of an eighth block pattern BP8 as an example of an embroidery area having a pair of main segments each defined by a spline curve, a pair of secondary segments each defined by a polygonal line, and a pair of aid main segments each defined by a spline curve, and respective stitches formed in the block pattern BP8.

H. Eighth Block Pattern BP8 (FIG. 11)

1) Basic Data

The basic data for the eighth block pattern BP8 includes twelve sets of coordinate data indicative of the coordinate positions of four defining points P1 to P4, two aid points g, h located on the first main segment L1, two aid points p, q located on the second main segment L2, two aid points E, G located on the first secondary segment L3, and two aid points F, H located on the second secondary segment L4; and six sets of shape data specifying that the two main segments L1, L2, a first aid main segment L6 connecting between the aid points E, F, and a second aid main segment L7 connecting between the aid points G, H each are defined by a spline curve, and specifying that the two secondary segments L3, L4 each are defined by a polygonal line. The aid points g, h have the smallest and greatest Y coordinates of all the points on the first main segment L1, respectively, and the aid points p, q have the smallest and greatest Y coordinates of all the points on the second main segment L2, respectively.

2) Determination of Main Segments L1, L2

The first main segment L1 is determined by connecting between the first and third defining points P1, P3 through the two aid points g, h by a spline curve. Similarly, the second main segment L2 is determined by connecting between the second and fourth defining points P2, P4 through the two aid points p, q by a spline curve.

3) Determination of Secondary Segments L3, L4

The first secondary segment (polygonal line) L3 is determined by connecting between the first and second defining points P1, P2 through the two aid points E, G by three straight line segments, and the second secondary segment (polygonal line) L4 is determined by connecting between the third and fourth defining points P3, P4 through the two aid points F, H by three straight line segments.

4) Determination of Aid Main Segments L6, L7

1. A point, s, is located on the second main segment L2 such that the ratio of the girth length of the spline curve segment between the points P1, g to that of the first main segment L1 is equal to the ratio of the girth length of the spline curve segment between the points P2, s to that of the second main segment L2, and a point, t, is located on the second main segment L2 such that the ratio of the girth length of the spline curve segment between the points h, P3 to that of the first main segment L1 is equal to the ratio of the girth length of the spline curve segment between the points t, P4 to that of the second main segment L2.

2. A point, c, is located on a straight line segment connecting between the points g, s such that the ratio of the length of the line segment between the points g, c to that of the line segment between the points c, s is equal to the ratio of the length of the line segment between the points P1, E to the sum of the lengths of the line segments between the points E, G and between the points G, P2. Similarly, a point, e, is located on a straight line segment connecting between the points h, t such that the ratio of the length of the line segment between the points h, e to that of the line segment between the points e, t is equal to the ratio of the length of the line segment between the points P3, F to the sum of the lengths of the line segments between the points F, H and the points H and P4. However, it is possible to determine a "ratio" function as described with respect to the seventh block pattern BP7, and locate the points c, e by utilizing the "ratio" function.

3. The first aid main segment L6 is determined by connecting between the two aid points E, F through the two points c, e by a spline curve. The spline curve L5 is determined by replacing the variables in the preselected function equation with the coordinates of the points E, F, c, e.

4. As described above with respect to the points c, e, a point, d, is located on the line segment between the points g, s such that the ratio of the length of the line segment between the points d, s to that of the line segment between the points g, d is equal to the ratio of the length of the line segment between the points G, P2 to the sum of the lengths of the line segments between the points Pl, E and between the points E, G, and a point, f, is located on the line segment between the points h, t such that the ratio of the length of the line segment between the points f, t to that of the line segment between the points h, f is equal to the ratio of the length of the line segment between the points H, P4 to the sum of the lengths of the line segments between the points P3, F and the points F, H. As described above with respect to the first aid main segment L6, the second aid main segment L7 is determined by connecting between the two aid points G, H through the two points d, f by a spline curve. However, it is possible to determine a "ratio" function as described with respect to the seventh block pattern BP7, and locate the points d, f by utilizing the "ratio" function.

5) Determination of Stitch Positions

1. As described above with respect to the third block pattern BP3, division points u1, u2, u3, . . . are determined on the first main segment L1 such that, starting from the first defining point P1, the points P1, u1, u2, u3, . . . are equidistant from each other; division points w1, w2, w3, . . . are determined on the second main segment L2 such that, starting from the second defining point P2, the points w1, w2, w3, . . . , P4 are equidistant from each other; division points b1, b2, b3, . . . are determined on the first aid main segment L6 such that, starting from the aid point E, the points E, b1, b2, b3, . . . , F are equidistant from each other, and intermediate division points j1, j2, j3, . . . are located at the $\frac{1}{3}$ or $\frac{2}{3}$ internally dividing point of each of the line segments between pairs of adjacent two points out of of the points E, b1, b2, b3, . . . , F on the first aid main segment L6; and division points c1, c2, c3, . . . are determined on the second aid main segment L7 such that, starting from the aid point G, the points G, c1, c2, c3, . . . , H are equidistant from each other, and intermediate division points k1, k2, k3, . . . are located at the $\frac{1}{3}$ or $\frac{2}{3}$ internally dividing point of each of the line segments between pairs of adjacent two points out of the points G, c1, c2, c3, . . . , H on the second aid main segment L7. However, it is possible to determine the intermediate points j1, j2, j3, . . . or the intermediate division points k1, k2, k3, . . . based on the ratios of the length of the line segment between the points 1P, E, to that of the line segment between the points E, G, and to that of the line segment between the points G, 2P, or the ratios of the length of the line segment between the points 3P, F, to that of the line segment between the points F, H, and to that of the line segment between the points H, 4P.

2. The first defining point P1, odd-number intermediate division points j1, j3, . . . on the first aid main segment L6, odd-number intermediate division points k1, k3, . . . on the second aid main segment L7, odd-number division points w1, w3, . . . on the second main segment L2, even-number intermediate division points j2, j4, . . . on the second aid main segment L7, even-number intermediate division points k2, k4, . . . on the first aid main segment L6, even-number division points u2, u4, . . . on the first main segment L1, . . . and the fourth defining point P4 are determined in sequence as stitch positions. Specifically, the points P1, j1, k1, w1, k2, j2, u2, j3, k3, w3, . . . , P4 are determined as stitch positions in the order of description.

Figure 12:
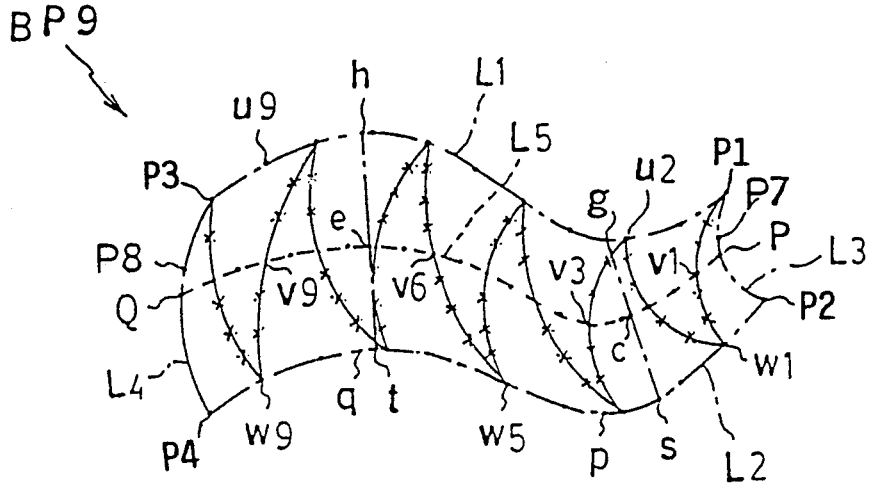
FIG. 12 is a view of a ninth block pattern BP as an example of an embroidery area having a pair of main segments each defined by a spline curve, a pair of secondary segments each defined by a circular arc, and an aid main segment defined by a spline curve, and respective stitches formed in the block pattern BP8.

I. Ninth Block Pattern BP9 (FIG. 12)

1) Basic Data

The basic data for the ninth block pattern BP9 includes ten sets of coordinate data indicative of the coordinate positions of four defining points P1 to P4, two aid points g, h located on the first main segment L1, two aid points p, q located on the second main segment L2, and two aid points P7, P8 respectively located on the two secondary segments L3, L4; and five sets of shape data specifying that the two main segments L1, L2 and an aid main segment L5 each are defined by a spline curve, and specifying that the two secondary segments L3, L4 each are defined by a circular arc. The aid points g, h have the smallest and greatest Y coordinates of all the points on the first main segment L1, respectively, and the aid points p, q have the smallest and greatest Y coordinates of all the points on the second main segment L2, respectively.

2) Determination of Main Segments L1, L2

As described with respect to the eighth block pattern BP8, the first main segment L1 is determined by a spline curve, and the second main segment L2 is determined by a spline curve.

3) Determination of Secondary Segments L3, L4

The first secondary segment L3 is determined by connecting between the first and second defining points Pl, P2 through the aid point P7 by a circular arc, and the second secondary segment L4 is determined by connecting between the third and fourth defining points P3, P4 through the aid point P8 by a circular arc.

4) Determination of Aid Main Segment L5

1. A point, P, is located at the midpoint of the girth length of the first secondary segment L3, and a point, Q, is located at the midpoint of the girth length of the second secondary segment L4.

2. As described with respect to the eighth block pattern BP8, two points, s, t, are located on the second main segment L2, a point, c, is located on a straight line segment connecting between the points g, s, and a point, e, is located on a straight line segment connecting between the points h, t.

3. The aid main segment L5 is determined by connecting between the two points P, Q through the two points c, e by a spline curve. The spline curve L5 is determined by replacing variables in a pre-selected function equation with the coordinates of the points P, Q, c, e.

5) Determination of Stitch Positions

1. As described with respect to the fifth block pattern BP5, division points u1, u2, u3, . . . are determined on the first main segment L1 such that, starting from the first defining point P1, the points P1, u1, u2, u3, . . . are equidistant from each other; division points w1, w2, w3, . . . are determined on the second main segment L2 such that, starting from the second defining point P2, the points w1, w2, w3, P4 are equidistant from each other; and division points b1, b2, b3, . . . are determined on the aid main segment L5 such that, starting from the point P, the points P, b1, b2, b3, Q are equidistant from each other, and intermediate division points v1, v2, v3, . . . are located at the midpoint of each of the line segments between pairs of adjacent two points out of the points P, b1, b2, b3, . . . , Q on the aid main segment L5.

2. A circular arc is determined which connects between the first defining point P1 and the division point w1 through the intermediate division point v1, and aid stitch positions are located on that circular arc at a pre-selected stitch pitch as indicated at symbols "x" in FIG. 12. Thus, the first defining point P1, aid stitch positions, intermediate division point v1, aid stitch positions, and division point w1 are determined as stitch positions in the order of description. Subsequently, a circular arc is determined which connects between the division point w1 and the division point u2 through the intermediate division point v2, and aid stitch positions are located on that circular arc at the pre-selected stitch pitch. Thus, the aid stitch positions, intermediate division point v2, aid stitch positions, and division point u2 are determined as stitch positions in the order of description. Then, similar operations are repeated, so that stitch positions are determined in sequence up to the fourth defining point P4.

Figure 13:
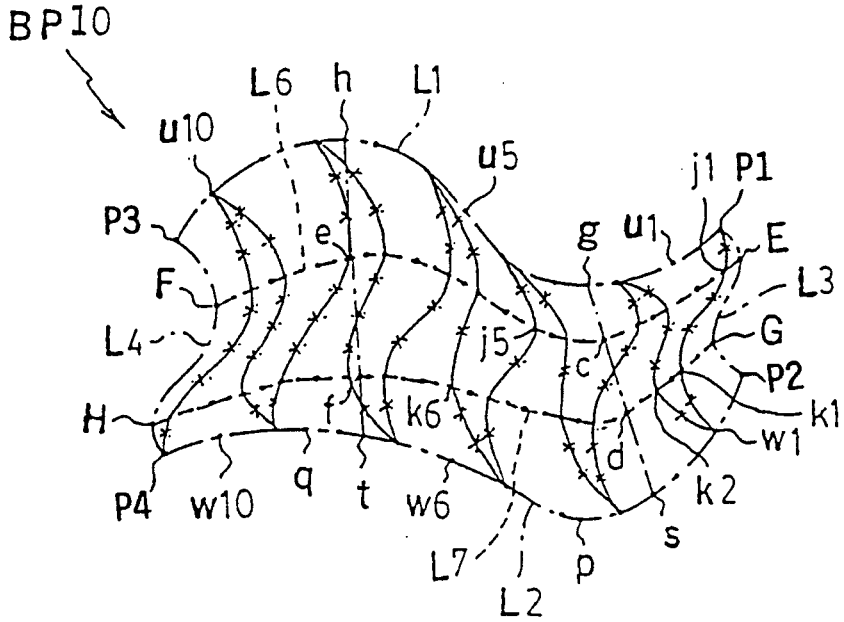
FIG. 13 is a view of a tenth block pattern BP10 as an example of an embroidery area having a pair of main segments each defined by a spline curve, a pair of secondary segments each defined by a spline curve, and a pair of aid main segments each defined by a spline curve, and respective stitches formed in the block pattern BP10.

J. Tenth Block Pattern BP10 (FIG. 13)

1) Basic Data

The basic data for the tenth block pattern BP10 includes twelve sets of coordinate data indicative of the coordinate positions of four defining points P1 to P4, two aid points g, h located on the first main segment L1, two aid points p, q located on the second main segment L2, two aid points E, G located on the first secondary segment L3, and two aid points F, H located on the second secondary segment L4; and six sets of shape data specifying that the two main segments L1, L2, a first aid main segment L6 connecting between the aid points E, F, a second aid main segment L7 connecting between the aid points G, H, and the two secondary segments L3, L4 each are defined by a spline curve. The aid points g, h have the smallest and greatest Y coordinates of all the points on the first main segment L1, respectively, and the aid points p, q have the smallest and greatest Y coordinates of all the points on the second main segment L2, respectively. In addition, the aid points E, G have the greatest and smallest X coordinates of all the points on the first secondary segment L3, respectively, and the aid points F, H have the greatest and smallest X coordinates of all the points on the second secondary segment L4, respectively 2) Determination of Main Segments L1, L2

Like the ninth block pattern BP9, the first main segment L1 is determined by a spline curve, and the second main segment L2 is determined by a spline curve.

3) Determination of Secondary Segments L3, L4

The first secondary segment L3 is determined by connecting between the first and second defining points P1, P2 through the two aid points E, G by a spline curve, and the second secondary segment L4 is determined by connecting between the third and fourth defining points P3, P4 through the two aid points F, H by a spline curve.

4) Determination of Aid Main Segments L6, L7

1. As described with respect to the eighth block pattern BP8, two points, s, t, are located on the second main segment L2, two points, c, d, are located on a straight line segment connecting between the points g, s, and two points, e, f, are located on a straight line segment connecting between the points h, t. The first aid main segment L6 is determined by connecting between the two aid points E, F through the two points c, e by a spline curve, and the second aid main segment L7 is defined by connecting between the two aid points G, H through the points d, f by a spline curve.

5) Determination of Stitch Positions

1. As described with respect to the eighth block pattern BP8, division points u1, u2, u3, . . . are determined on the first main segment L1 such that, starting from the first defining point P1, the points P1, u1, u2, u3, . . . are equidistant from each other; division points w1, w2, w3, . . . are determined on the second main segment L2 such that, starting from the second defining point P2, the points w1, w2, w3, . . . , P4 are equidistant from each other; division points b1, b2, b3, . . . are determined on the first aid main segment L6 such that, starting from the aid point E, the points E, b1, b2, b3, . . . , F are equidistant from each other, and intermediate division points j1, j2, j3, . . . are located on each of the line segments between pairs of adjacent two points out of the points E, b1, b2, b3, . . . , F on the first aid main segment L6; and division points c1, c2, c3, . . . are determined on the second aid main segment L7 such that, starting from the aid point G, the points G, c1, c2, c3, . . . , H are equidistant from each other, and intermediate division points k1, k2, k3, . . . are located on each of the line segments between pairs of adjacent two points out of the points G, c1, c2, c3, . . . , H on the second aid main segment L7.

2. Generally as described with respect to the eighth block pattern BP8, a spline curve is determined which connects between the first defining point P1 and the division point w1 through the two intermediate division points j1, k1, and aid stitch positions are located on that spline curve at a pre-selected stitch pitch as indicated at symbols "x" in FIG. 13. Thus, the first defining point P1, aid stitch positions, intermediate division point j1, aid stitch positions, intermediate division point k1, aid stitch positions, and division point w1 are determined as stitch positions in the order of description. Subsequently, a spline curve is determined which connects between the division point w1 and the division point u2 through the two intermediate division points j2, k2, and aid stitch positions are located on that spline curve at the pre-selected stitch pitch. Thus, the aid stitch positions, intermediate division point k2, aid stitch positions, intermediate division point 32 aid stitch positions, and division point u2 are determined as stitch positions in the order of description. Then, similar operations are repeated, so that stitch positions are determined in sequence up to the fourth defining point P4.

Hereunder, by reference to the flow charts of FIGS. 14 through 19, there will be described the operations of the control device 78 of the data processing device 55 for producing embroidery data (i.e., sets of stitch position data) used by the embroidery sewing machine 2 to form respective stitches filling each of the first to fifth block patterns BP1 to BP5 and thereby embroidering each block pattern BP. The explanation of the embroidery data producing operations for the sixth to tenth block patterns BP6 to BP10 are omitted.

Figure 14:
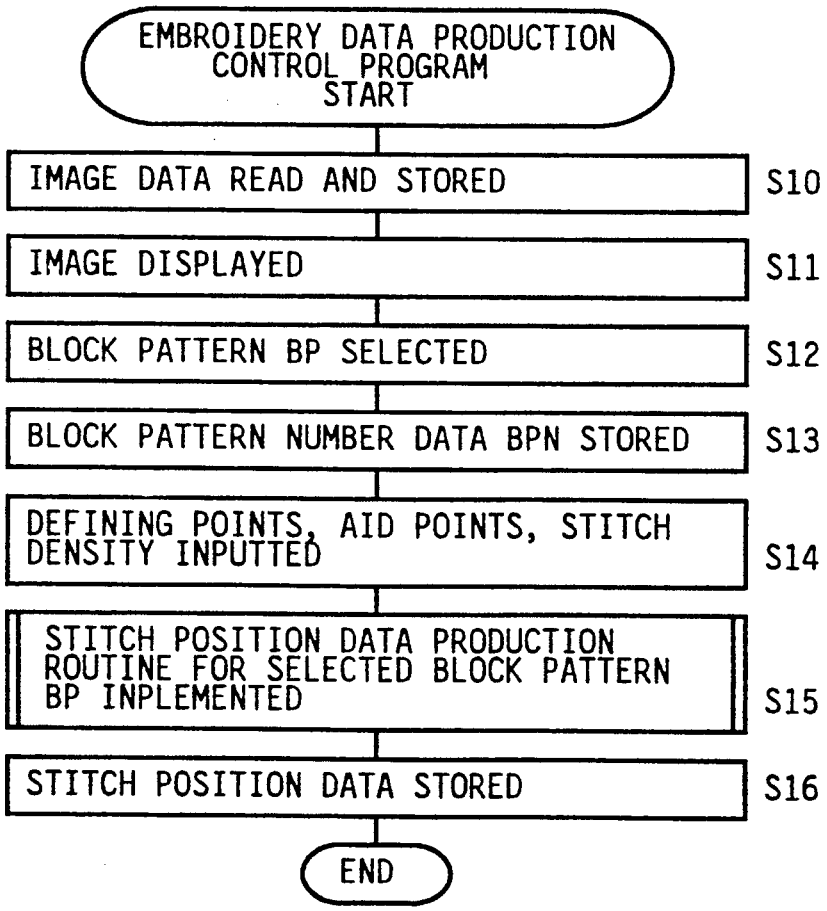
FIG. 14 is a flow chart representing the embroidery data production control program implemented by the sewing system of FIG. 1.

Initially, an operator operates the keyboard 57 to input a command to commence the implementation of the embroidery data production control program represented by the flow chart of FIG. 14.

In Step S10, the control device 78 or the CPU 63 automatically operates the image scanner 60 to read in an image, and stores image data representative of the image in the image data memory of the RAM 65. Subsequently, in Step S11, the CPU 63 operates the CRT display 56 to display the image read in by the image scanner 60. In Step S12, the operator operates the keyboard 57 to select a desired one of the ten block patterns BP1 to BP10, and in Step S13 the CPU 63 stores block pattern number (BPN) data indicative of the selected block pattern in a BPN data memory provided in the RAM 65. In Step S14, the operator operates the keyboard 57 to input and store stitch density data indicative of a number of stitches formed in unit length as measured in the stitch forming direction from the first secondary segment L3 toward the second secondary segment L4, and operates the mouse 59 to input and store sets of coordinate data representative of the coordinate positions of defining points and aid points necessary for producing embroidery data, and in Step S15 the CPU 63 commences to produce embroidery data based on the stitch density data, sets of coordinate data, and BPN data, i.e., produce sets of stitch-position data necessary for forming respective stitches filling the selected block pattern and thereby embroidering the image read in by the image scanner 60.

Figure 15:
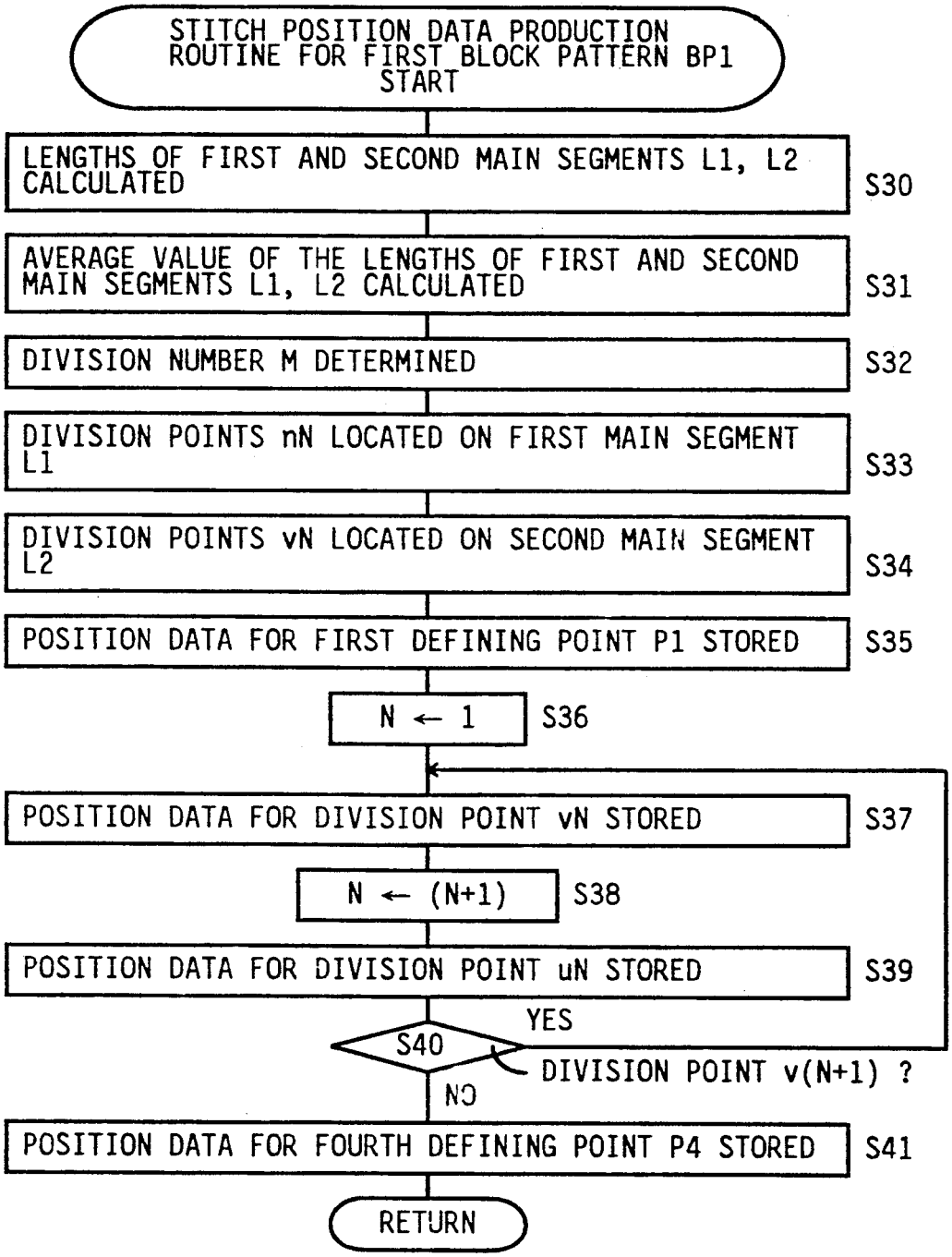
FIG. 15 is a flow chart representing the sub-routine for producing embroidery data for the first block pattern BP1.

First, there will be described the operation of the CPU 63 for producing embroidery data for the first block pattern BP1 selected, by reference to FIG. 3 and the flow chart of FIG. 15. Initially, in Step S30, the CPU 63 calculates lengths of the first and second main segments L1, L2 based on the sets of coordinate data of the four defining points P1 to P4 which have been inputted and stored in Step S14. Subsequently, in Step S31, the CPU 63 calculates an average value, X, of the lengths of the first and second main segments L1, L2. Then, in Step S32, the CPU 63 calculates a division number, M (natural number), by dividing the average value X by a stitch pitch, t, defined by the stitch density data which have been inputted and stored in Step S14. In the event that the division number M is an even number, one is added to the number M to obtain an odd number. Step S32 is followed by Step S33 to equally divide the length of the first main segment L1 by the division number M to locate division points uN (u1, u2, u3, . . . ) on the first main segment L1 such that the points P1, uN, P3 are equidistant from each other. Sets of coordinate data representative of the coordinate positions of the points P1, uN, P3 are stored in sequence in a division position data buffer provided in the RAM 65. Similarly, in Step S34, the length of the second main segment L2 is equally divided by the division number M to locate division points vN (v1, v2, v3, . . . ) on the second main segment L2 such that the points P2, vN, P4 are equidistant from each other. Sets of coordinate data representative of the coordinate positions of the points P2, vN, P4 are stored in sequence in the division position data buffer of the RAM 65.

In Step S35, the set of coordinate data for the first defining point P1 is stored in a stitch position data buffer provided in the RAM 65, and in Step S36 a stitch position number counter, N, provided in the RAM 65 is incremented by one. Subsequently, in Step S37, the set of coordinate data for the division point vN is stored in the stitch position data buffer, and in Step S38 the stitch position-number counter N is incremented by one. In Step S39, the set of coordinate data for the division point uN is stored in the stitch position data buffer. In Step S40, the CPU 63 identifies whether or not there is left the set of coordinate data for the division point v(N+1). If an affirmative result (YES) is provided in Step S40, the control of the CPU 63 returns to Step S37 to repeat the implementation of Steps S37 to S40. On the other hand, if a negative result (NO) is provided in Step S40, the control of the CPU 63 proceeds with Step S41 to store the set of coordinate data for the fourth defining point P4 in the stitch position data buffer of the RAM 65. Thus, one cycle of this routine is ended.

Figure 16A:
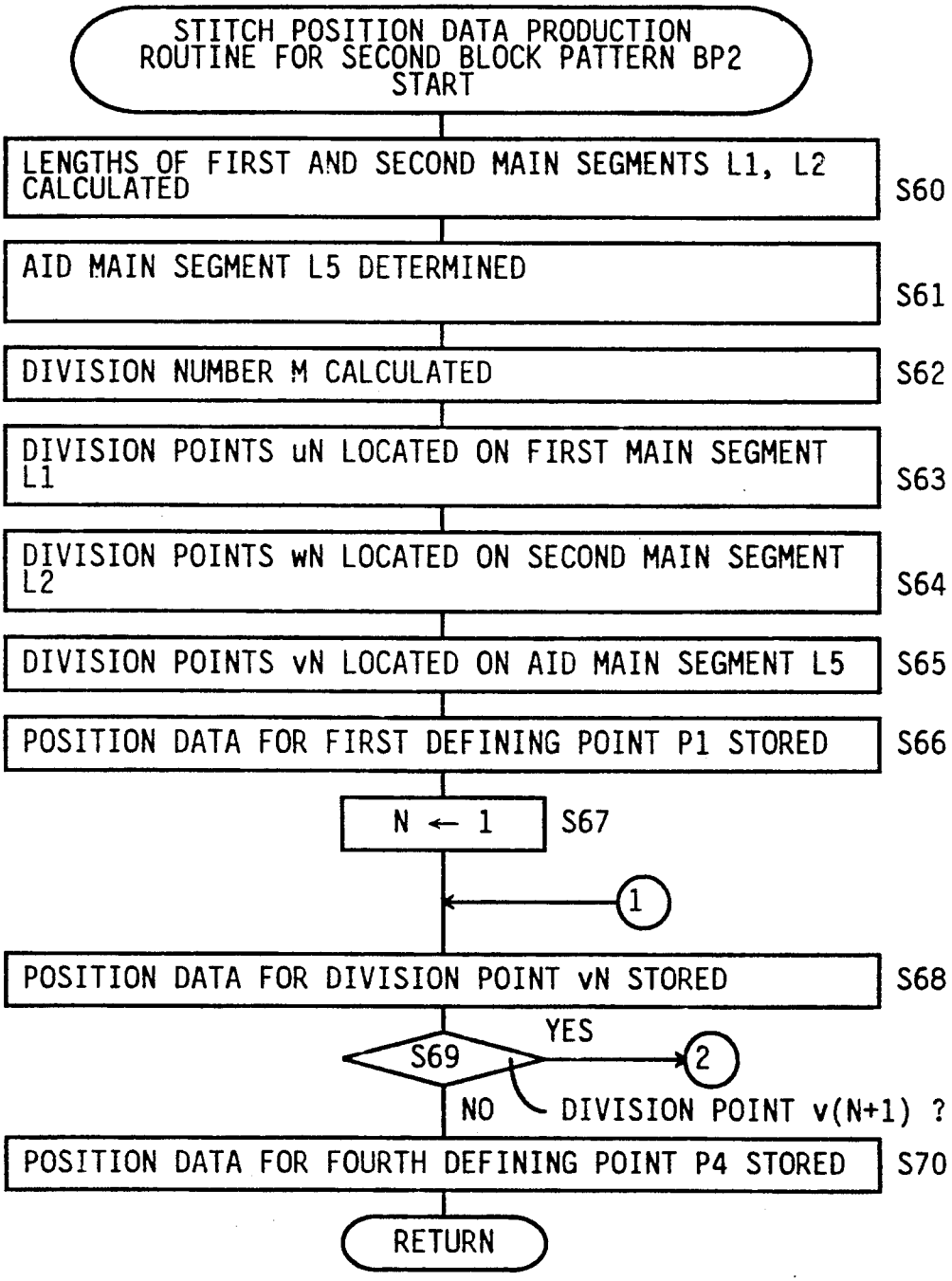
FIGS. 16A & 16B are flow charts representing the sub-routine for producing embroidery data for the second block pattern BP2.
Figure 16B:
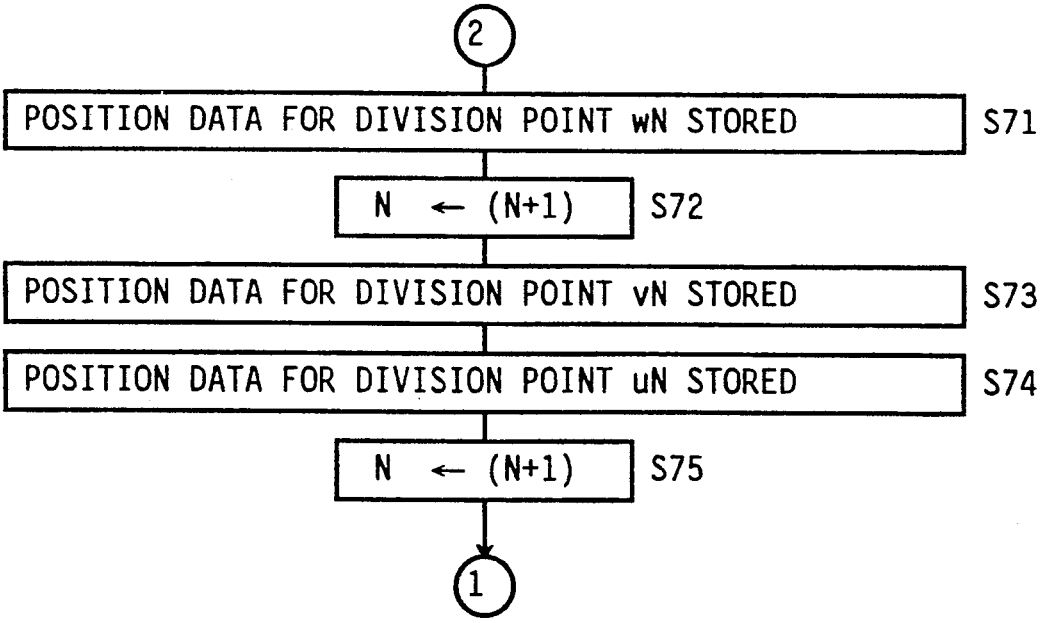

Next, there will be described the operation of the CPU 63 for producing embroidery data for the second block pattern BP2 selected, by reference to FIG. 4 and the flow chart of FIG. 16 (16A & 16B). Initially, in Step S60, the CPU 63 calculates lengths of the first and second main segments L1, L2 based on the sets of coordinate data of the four defining points P1 to P4. Subsequently, in Step S61, the CPU 63 determines the aid main segment L5 based on the sets of coordinate data of the two aid points P, Q which have been inputted and stored in Step S14. Then, in Step S62, the CPU 63 calculates a division number, M, by dividing the length of the aid main segment L5 by a stitch pitch, t, defined by the stitch density data which have been inputted and stored in Step S14. In the event that the division number M is an even number, one is added to the number M to obtain an odd number. Step S62 is followed by Step S63 to equally divide the length of the first main segment L1 by the division number M to locate division points uN (u1, u2, u3, . . . ) on the first main segment L1 such that the points P1, uN, P3 are equidistant from each other. Sets of coordinate data representative of the coordinate positions of the points P1, uN, P3 are stored in sequence in the division position data buffer of the RAM 65. Similarly, in Step S64, the length of the second main segment L2 is equally divided by the division number M to locate division points wN (w1, w2, w3, . . . ) on the second main segment L2 such that the points P2, wN, P4 are equidistant from each other. Sets of coordinate data representative of the coordinate positions of the points P2, wN, P4 are stored in sequence in the division position-data buffer. In addition, in Step S65, the length of the aid main segment L5 is equally divided by a division number 2M (i.e., two times the number M) to locate division points equidistant from each other on the aid main segment L5 and select from the equidistant division points the odd-numbered points vN (v1, v2, v3, . . . ) as counted from the side of the aid point P. Sets of coordinate data representative of the coordinate positions of the selected points vN are stored in sequence in the division position data buffer.

In Step S66, the set of coordinate data for the first defining point P1 is stored in the stitch position data buffer of the RAM 65, and in Step S67 the stitch position number counter N is incremented by one. Subsequently, in Step S68, the set of coordinate data for the division point vN is stored in the stitch position data buffer, and in Step S69 the CPU 63 identifies whether or not there is left the set of coordinate data for the division point v(N+1). If an affirmative result is obtained in Step S69, the control of the CPU 63 goes to Step S71 to store the set of coordinate data for the division point wN in the stitch position data buffer and subsequently to Step S72 to increment by one the stitch position number counter N. Step S72 is followed by Step S73 to store the set of coordinate data for the division point vN, and subsequently by Step S74 to store the set of coordinate data for the division point uN, each in the stitch position data buffer. In Step S75, the CPU 63 increments by one the stitch position number counter N. Following Step S75, the control of the CPU 63 returns to Step S68 and repeat the implementation of Steps S68 to S75.

On the other hand, if a negative result is obtained in Step S69, the control of the CPU 63 proceeds with Step S70 to store the set of coordinate data for the fourth defining point P4 in the stitch position data buffer of the RAM 65. Thus, one cycle of this routine is ended.

Figure 17A:
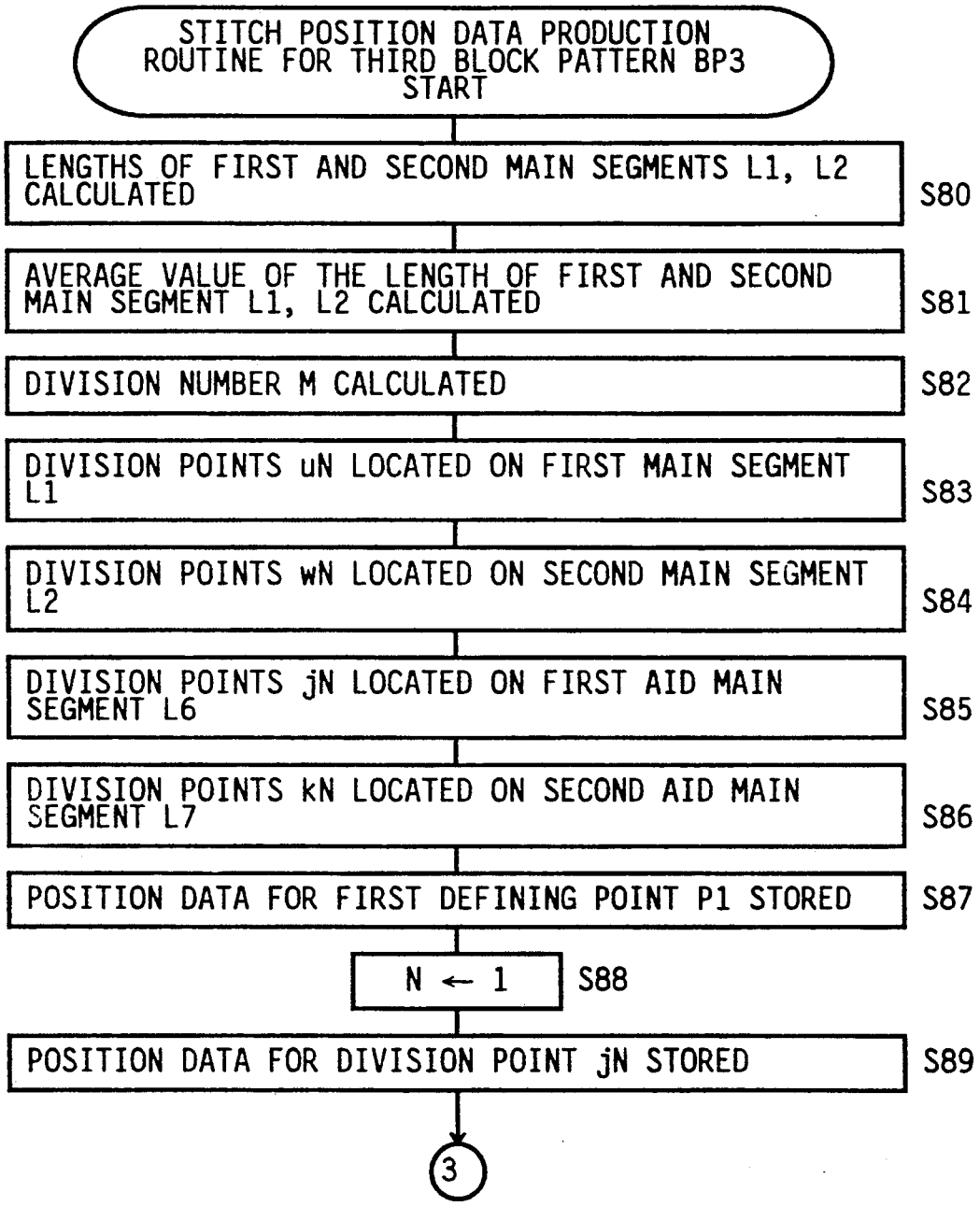
FIGS. 17A & 17B are flow charts representing the sub-routine for producing embroidery data for the third block pattern BP3.
Figure 17B:
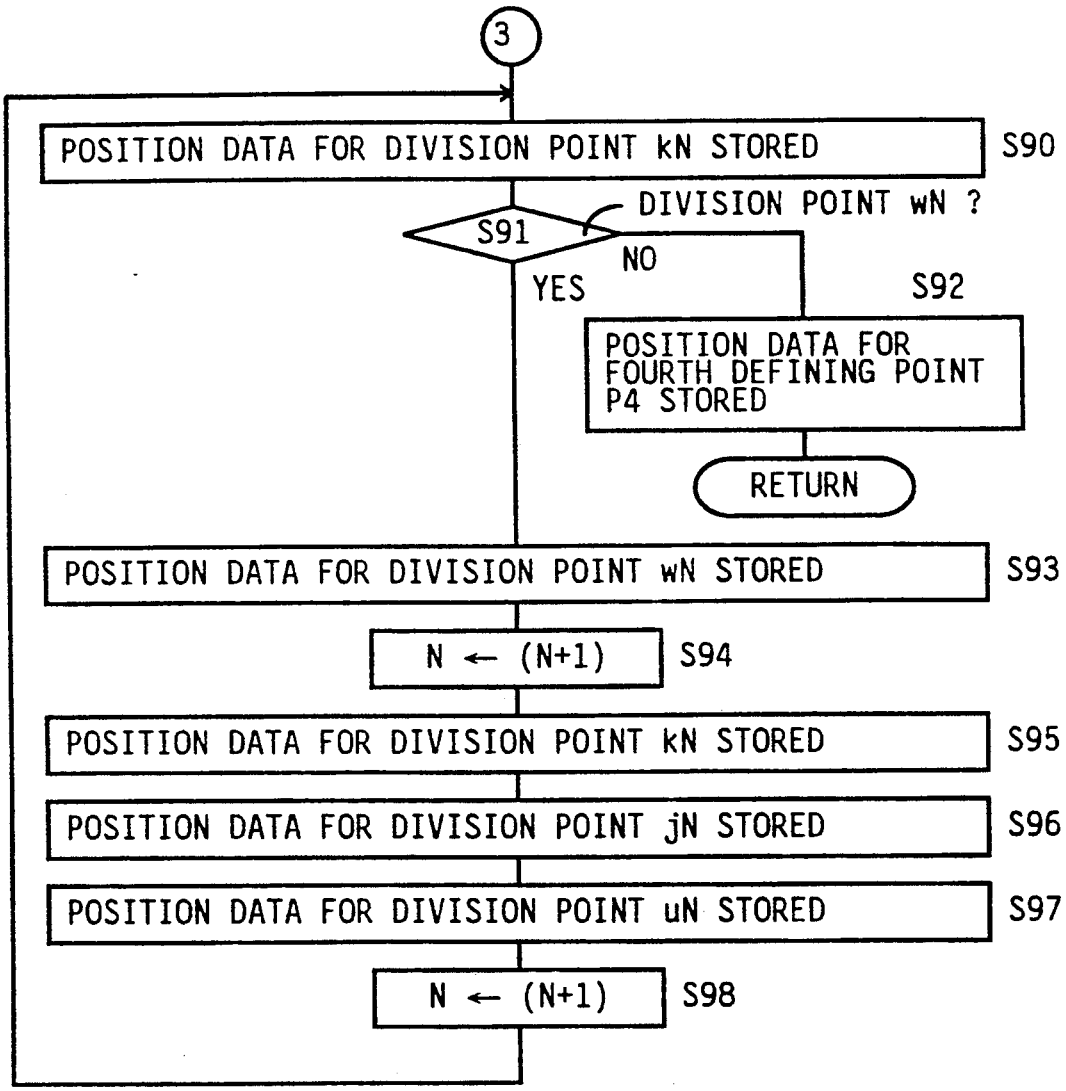

There will be described the operation of the CPU 63 for producing embroidery data for the third block pattern BP3 selected, by reference to FIG. 5 and the flow chart of FIG. 17 (17A & 17B). First, in Step S80, the CPU 63 calculates lengths of the first and second main segments L1, L2 based on the sets of coordinate data of the four defining points P1 to P4, and calculates lengths of the first and second aid main segments L6, L7 based on the sets of coordinate data of the four aid points E, F, G, H. Subsequently, in Step S81, the CPU 63 determines an average value, X, of the first and second aid main segments L6, L7. Then, in Step S82, the CPU 63 calculates a division number, M, by dividing the average value X by a stitch pitch, t, defined by the stitch density data which have been inputted and stored in Step S14. In the event that the division number M is an even number, one is added to the number M to obtain an odd number. Step S82 is followed by Step S63 to equally divide the length of the first main segment L1 by the division number M to locate division points uN (u1, u2, u3, . . . ) on the first main segment L1 such that the points P1, uN, P3 are equidistant from each other. Sets of coordinate data representative of the coordinate positions of the points P1, uN, P3 are stored in sequence in the division position data buffer of the RAM 65. Similarly, in Step S84, the length of the second main segment L2 is equally divided by the division number M to locate division points wN (w1, w2, w3, . . . ) on the second main segment L2 such that the points P2, wN, P4 are equidistant from each other. Sets of coordinate data representative of the coordinate positions of the points wN, P4 are stored in sequence in the division position data buffer. In addition, in Step S85, the length of the first aid main segment L6 is equally divided by a division number 3M (i.e., three times the number M) to locate division points equidistant from each other on the segment L6 and select the points jN (j1, j2, j3, . . . ) left by removing from the equidistant division points the 3n(n: natural number)-numbered and odd-numbered points as counted from the side of the aid point E. Sets of coordinate data representative of the coordinate positions of the points jN are stored in sequence in the division position data buffer. Similarly, in Step S86, the length of the second aid main segment L7 is equally divided by the division number 3M to locate division points equidistant from each other on the segment L7 and select the points kN (k1, k2, k3, left by removing from the equidistant division points the 3n(n: natural number)-numbered and odd-numbered points as counted from the side of the aid point G. Sets of coordinate data representative of the coordinate positions of the points kN are stored in sequence in the division position data buffer.

In Step S87, the set of coordinate data for the first defining point P1 is stored in the stitch position data buffer of the RAM 65, and in Step S88 the stitch position number counter N is incremented by one. Subsequently, in Step S89, the set of coordinate data for the division point jN is stored in the stitch position data buffer, and in Step S90 the set of coordinate data for the division point kN is stored in the stitch position data buffer. Step S90 is followed by Step S91 to identify whether or not there is left the set of coordinate data for the division point wN. If an affirmative result is obtained in Step S91, the control of the CPU 63 goes to Step S93 to store the set of coordinate data for the division point wN in the stitch position data buffer and subsequently to Step S94 to increment by one the stitch position number counter N. Step S94 is followed by Step S95 to store the set of coordinate data for the division point kN, subsequently by Step S96 to store the set of coordinate data for the division point jN, and additionally by Step S97 to store the set of coordinate data for the division point uN, each in the stitch position data buffer. In Step S98, the CPU 63 increments by one the stitch position number counter N. Following Step S98, the control of the CPU 63 returns to Step S90 and repeat the implementation of Steps S90 to S98.

On the other hand, if a negative result is obtained in Step S91, the control of the CPU 63 proceeds with Step S92 to store the set of coordinate data for the fourth defining point P4 in the stitch position data buffer. Thus, one cycle of this routine is ended.

Figure 18A:
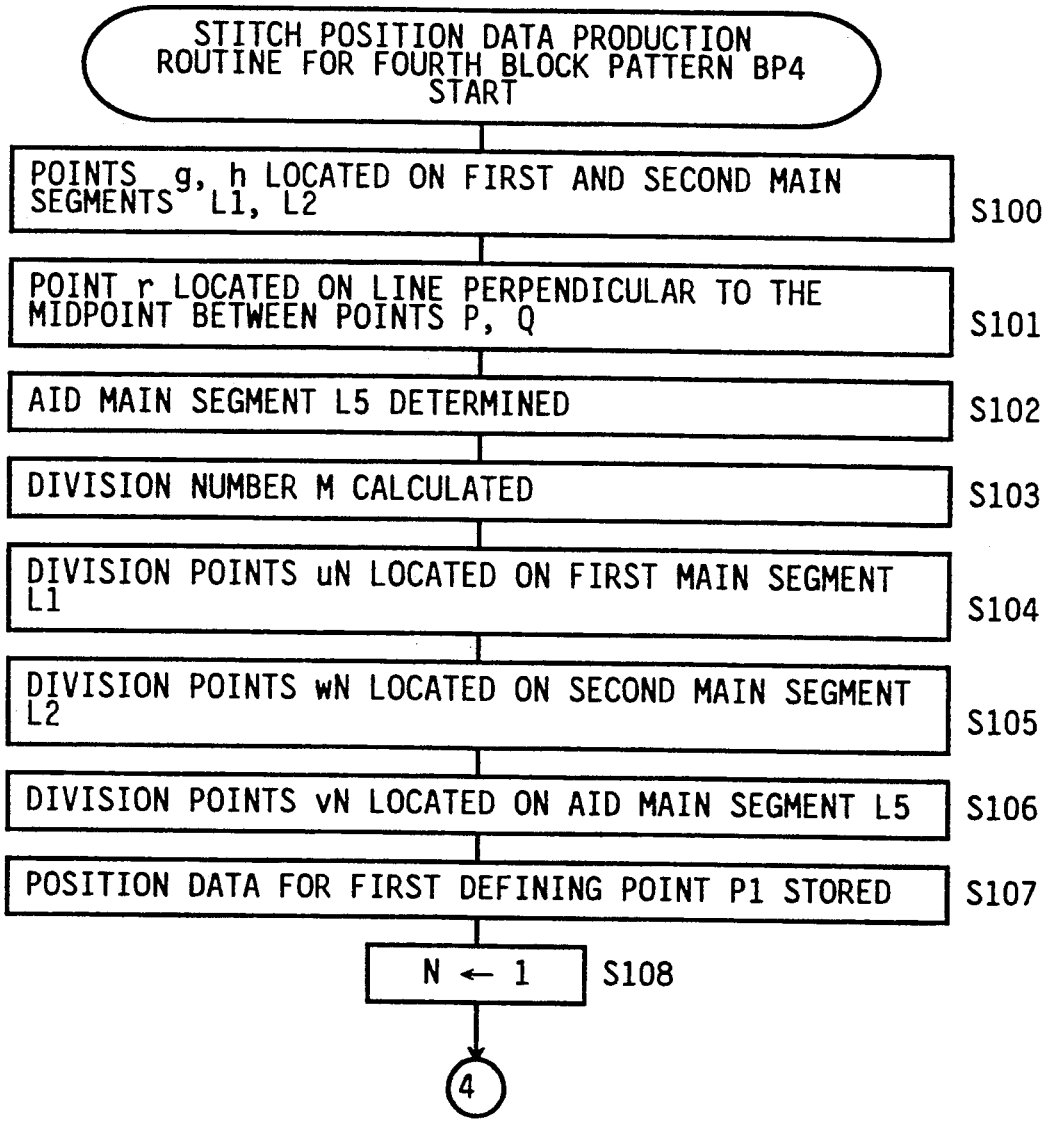
FIGS. 18A & 18B are flow charts representing the sub-routine for producing embroidery data for the fourth block pattern BP4.
Figure 18B:
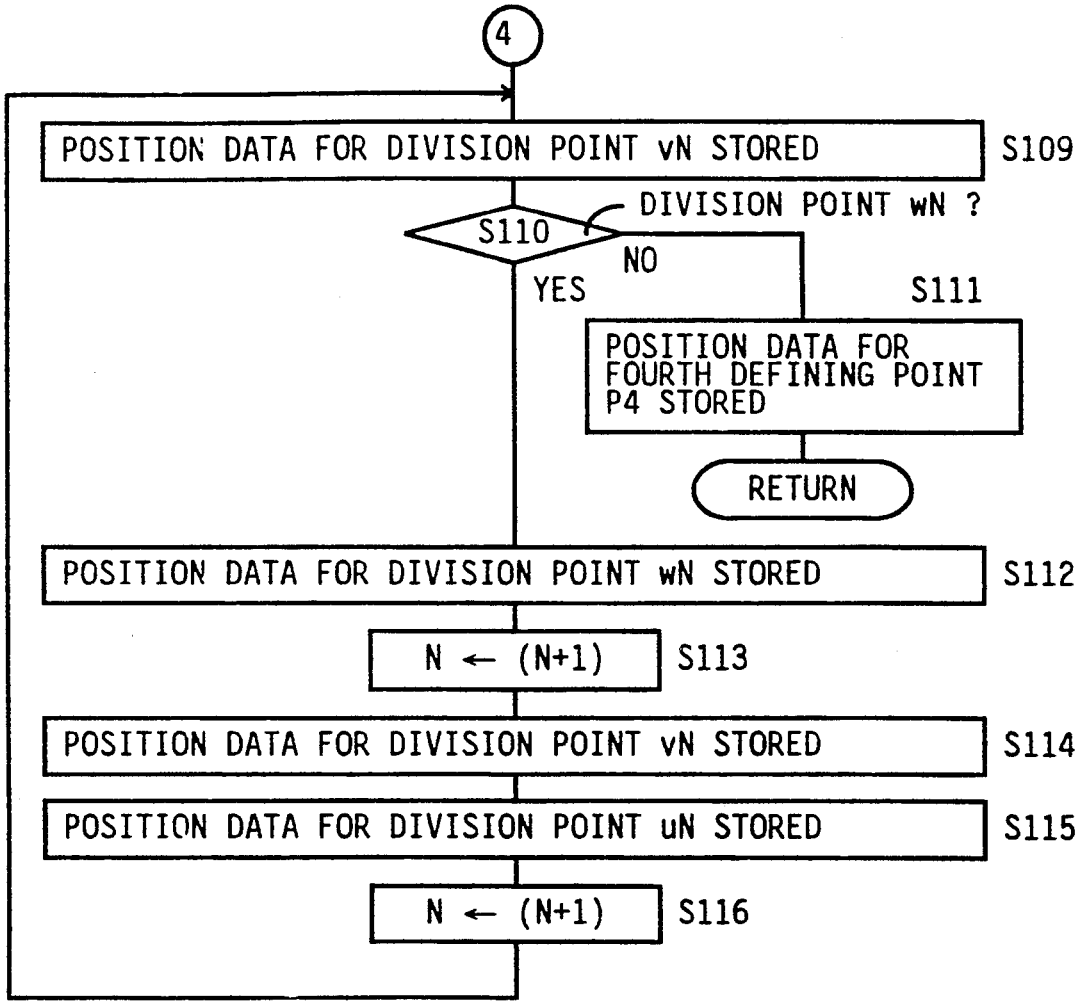

There will be described the operation of the CPU 63 for producing embroidery data for the fourth block pattern BP4 selected, by reference to FIG. 6 and the flow chart of FIG. 18 (18A & 18B). Initially, in Step S100, the CPU 63 determines a circular arc defining the first main segment L1 connecting between the first and third defining points P1, P3 through the aid point P5, and a circular arc defining the second main segment L2 connecting between the second and fourth defining points P2, P4 through the aid point P6. In addition, the CPU 63 locates a point, g, at the midpoint of the girth length of the circular arc L1 and a point, h, at the midpoint of the girth length of the circular arc L2. Subsequently, in Step S101, the CPU 63 determines a straight line, a, perpendicular to a straight line segment connecting between the aid points P, Q, and locates a point, r, on the straight line a such that the distance between the points g, r is equal to that between the points r, h. Then, in Step S102, the CPU 63 determines a circular arc defining the aid main segment L5 connecting between the aid points P, Q through the point r.

In Step S103, the CPU 63 calculates a division number, M, by dividing the girth length of the aid main segment L5 by a stitch pitch, t, defined by the stitch density data which have been inputted and stored in Step S14. In the event that the division number M is an even number, one is added to the number M to obtain an odd number. Step S103 is followed by Step S104 to equally divide the length of the first main segment L1 by the division number M to locate division points uN (u1, u2, u3, . . . ) on the first main segment L1 such that the points P1, uN, P3 are equidistant from each other. Sets of coordinate data representative of the coordinate positions of the points P1, uN, P3 are stored in sequence in the division position data buffer of the RAM 65. Similarly, in Step S105, the length of the second main segment L2 is equally divided by the division number M to locate division points wN (w1, w2, w3, . . . ) on the second main segment L2 such that the points P2, wN, P4 are equidistant from each other. Sets of coordinate data representative of the coordinate positions of the points P2, wN, P4 are stored in sequence in the division position data buffer. In addition, in Step S106, the length of the aid main segment L5 is equally divided by a division number 2M to locate division points equidistant from each other on the aid main segment L5 and select from the equidistant division points the odd-numbered points vN (v1, v2, v3, . . . ) as counted from the side of the aid point P. Sets of coordinate data representative of the coordinate positions of the points vN are stored in sequence in the division position data buffer.

In Step S107, the set of coordinate data for the first defining point P1 is stored in the stitch position data buffer of the RAM 65, and in Step S108 the stitch position number counter N is set to an initial value, one ("1"). Subsequently, in Step S109, the set of coordinate data for the division point vN is stored in the stitch position data buffer, and in Step S110 the CPU 63 identifies whether or not there is left the set of coordinate data for the division point wN. If an affirmative result is obtained in Step S110, the control of the CPU 63 goes to Step S112 to store the set of coordinate data for the division point wN in the stitch position data buffer and subsequently to Step S113 to increment by one the stitch position number counter N. Step S113 is followed by Step S114 to store the set of coordinate data for the division point vN, and subsequently by Step S115 to store the set of coordinate data for the division point uN, each in the stitch position data buffer. In Step S116, the CPU 63 increments by one the stitch position number counter N. Following Step S116, the control of the CPU 63 returns to Step S109 and repeats the implementation of Steps S109 to S116.

On the other hand, if a negative result is obtained in Step S110, the control of the CPU 63 proceeds with Step S111 to store the set of coordinate data for the fourth defining point P4 in the stitch position data buffer. Thus, one cycle of this routine is ended.

Figure 19A:
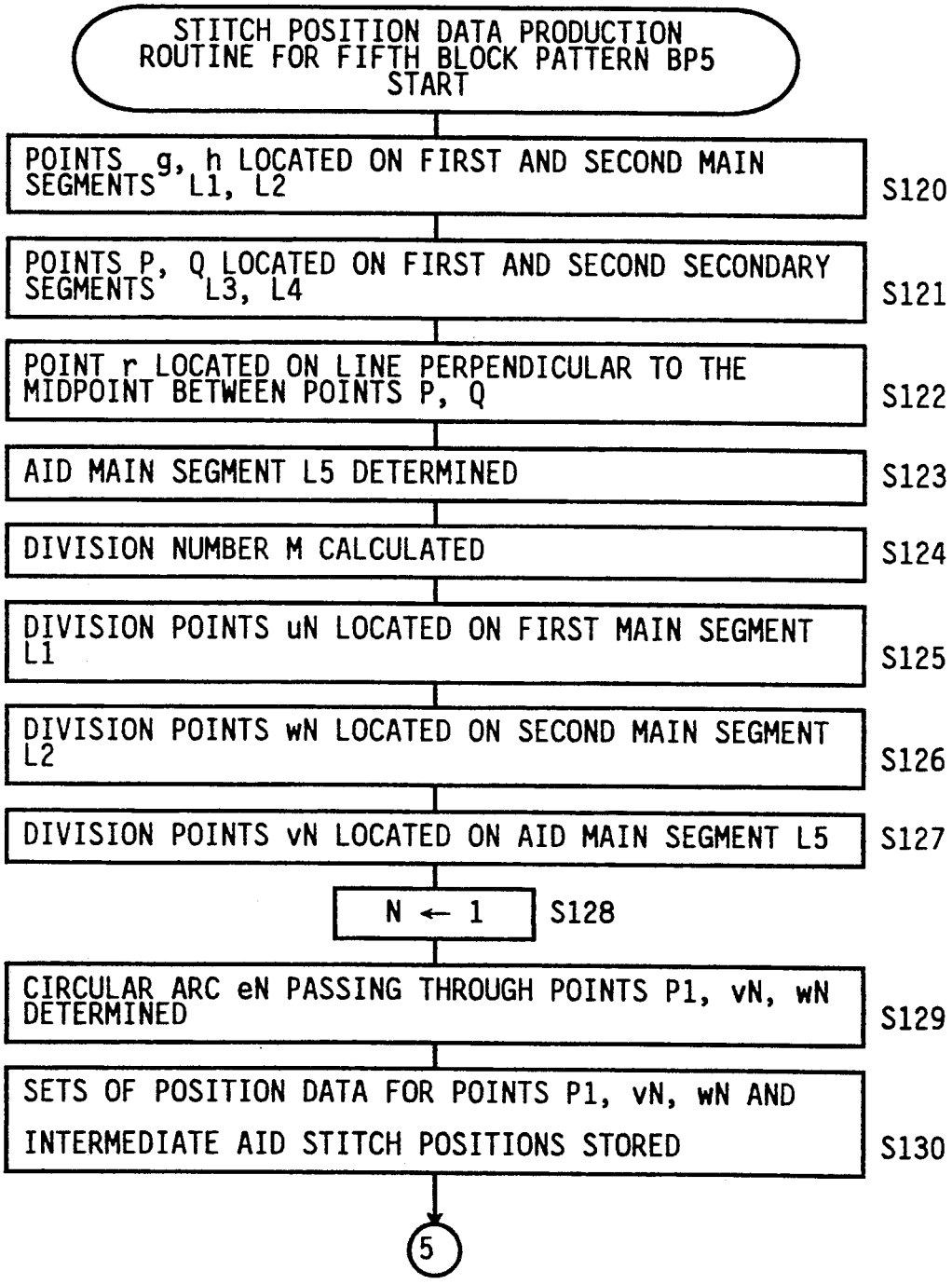
FIGS. 19A & 19B are flow charts representing the sub-routine for producing embroidery data for the fifth block pattern BP5.
Figure 19B:
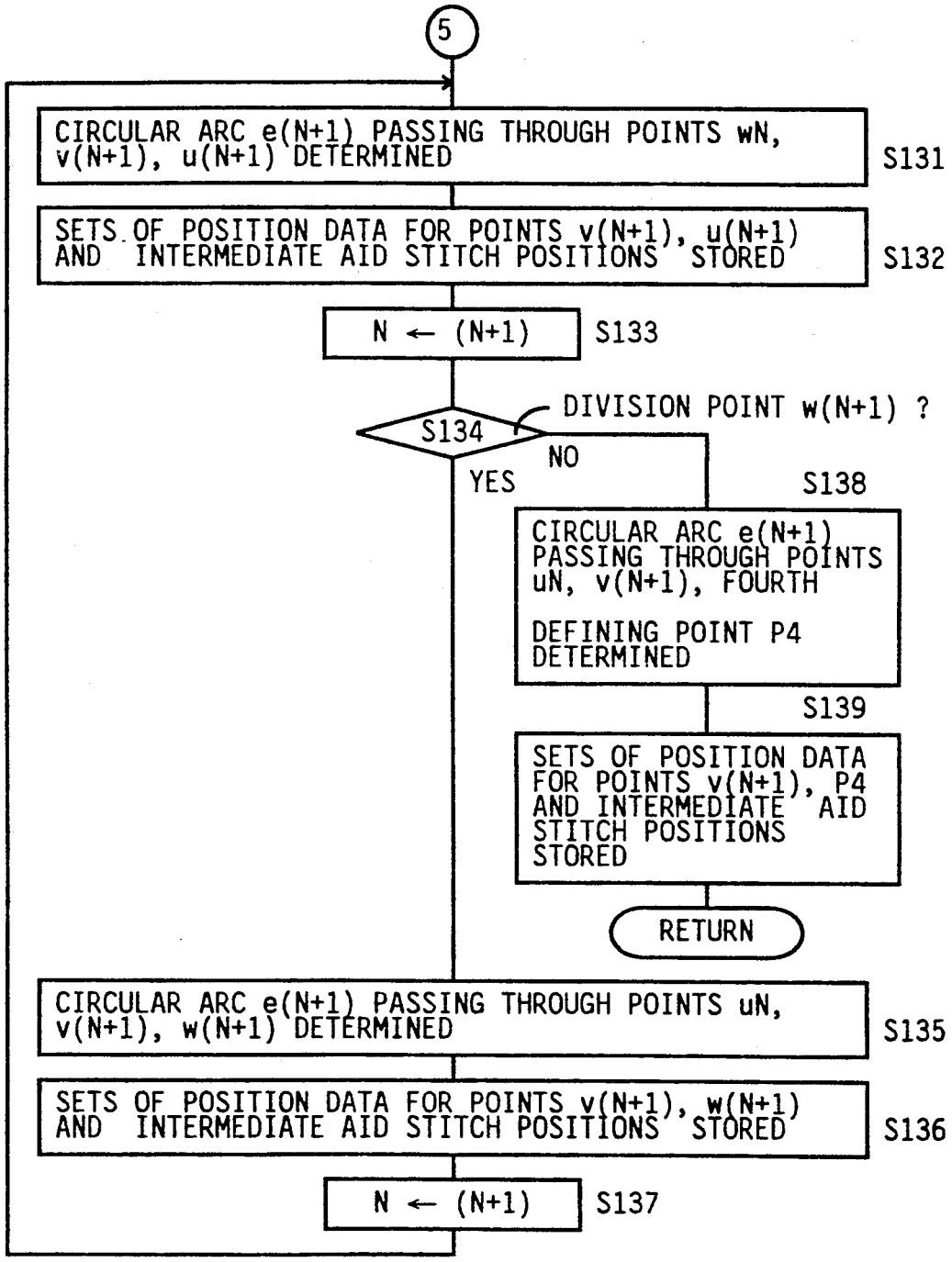

Finally, there will be described the operation of the CPU 63 for producing embroidery data for the fifth block pattern BP5 selected, by reference to FIG. 7 and the flow chart of FIG. 19 (19A & 19B). Initially, in Step S120, the CPU 63 determines a circular arc defining the first main segment L1 connecting between the first and third defining points P1, P3 through the aid point P5, and a circular arc defining the second main segment L2 connecting between the second and fourth defining points P2, P4 through the aid point P6. In addition, the CPU 63 locates a point, g, at the midpoint of the girth length of the circular arc L1 and a point, h, at the midpoint of the girth length of the circular arc L2. Similarly, in Step S121, the CPU 63 determines a circular arc defining the first secondary segment L3 connecting between the first and second defining points P1, P2 through the aid point P7, and a circular arc defining the second secondary segment L4 connecting between the third and fourth defining points P3, P4 through the aid point P7. In addition, the CPU 63 locates a point, P, at the midpoint of the girth length of the circular arc L3 and a point, Q, at the midpoint of the girth length of the circular arc L4. Subsequently, in Step S122, the CPU 63 determines a straight line, a, perpendicular to a straight line segment connecting between the aid points P, Q, and locates a point, r, on the straight line a such that the distance between the points g, r is equal to that between the points r, h. Then, in Step S123, the CPU 63 determines a circular arc defining the aid main segment L5 connecting between the points P, Q through the point r.

In Step S124, the CPU 63 calculates a division number, M, by dividing the girth length of the aid main segment L5 by a stitch pitch, t, defined by the stitch density data which have been inputted and stored in Step S14. In the event that the division number M is an even number, one is added to the number M to obtain an odd number. Step S124 is followed by Step S125 to equally divide the length of the first main segment L1 by the division number M to locate division points uN (u1, u2, u3, . . . ) on the first main segment L1 such that the points P1, uN, P3 are equidistant from each other. Sets of coordinate data representative of the coordinate positions of the points P1, uN, P3 are stored in sequence in the division position data buffer of the RAM 65. Similarly, in Step S126, the length of the second main segment L2 is equally divided by the division number M to locate division points wN (w1, w2, w3, . . . ) on the second main segment L2 such that the points P2, wN, P4 are equidistant from each other. Sets of coordinate data representative of the coordinate positions of the points P2, wN, P4 are stored in sequence in the division position data buffer. In addition, in Step S127, the length of the aid main segment L5 is equally divided by a division number 2M to locate division points equidistant from each other on the aid main segment L5 and select from the equidistant division points the odd-numbered points vN (v1, v2, v3, . . . ) as counted from the side of the point P. Sets of coordinate data representative of the coordinate positions of the points vN are stored in sequence starting from the point v1 in the division position data buffer.

In Step S128, the set of coordinate data for the first defining point P1 is stored in the stitch position data buffer of the RAM 65. Subsequently, in Step S129, the CPU 63 determines a circular arc, eN, passing through three points, i.e., first defining point P1, division point vN, and division point wN. Step S129 is followed by Step S130 to locate a plurality of aid stitch positions at a pre-selected stitch pitch on the circular arc eN, and store sets of coordinate data representative of the coordinate positions of the aid stitch positions, division point vN, aid stitch positions, and division point wN, in the order of description, in the stitch position data buffer. In Step S131, the CPU 63 determines a circular arc, e(N+1), passing through three division points wN, v(N+1), point u(N+1). Step S131 is followed by Step S132 to locate a plurality of aid stitch positions at the pre-selected stitch pitch on the circular arc e(N+1), and store sets of coordinate data representative of the coordinate positions of the aid stitch positions, division point v(N+1), aid stitch positions, and division point u(N+1), in the order of description, in the stitch position data buffer.

In Step S133, the stitch position number counter N is incremented by one. Subsequently, in Step S134, the CPU 63 identifies whether or not there is left the set of coordinate data for the division point w(N+1). If an affirmative result is obtained in Step S134, the control of the CPU 63 goes to Step S135 to determine a circular arc, e(N+1), passing through three division points uN, v(N+1), w(N+1). Step S135 is followed by Step S136 to locate a plurality of aid stitch positions at the pre-selected stitch pitch on the circular arc e(N+1), and store sets of coordinate data representative of the coordinate positions of the aid stitch positions, division point v(N+1), aid stitch positions, and division point w(N+1), in the order of description, in the stitch position data buffer. In Step S137, the CPU 63 increments by one the stitch position number counter N, and thereafter the control of the CPU 63 returns to Step S131 and repeats the implementation of Steps S131 to S137.

On the other hand, if a negative result is obtained in Step S134, the control of the CPU 63 proceeds with Step S138 to determine a circular arc, e(N+1), passing through three points, i.e., division point uN, division point v(N+1), and fourth defining point P4. Step S138 is followed by Step S139 to locate a plurality of aid stitch positions at the pre-selected stitch pitch on the circular arc e(N+1), and store sets of coordinate data representative of the coordinate positions of the aid stitch positions, division point v(N+1), aid stitch positions, and fourth defining point P4, in the order of description, in the stitch position data buffer. Thus, one cycle of this routine is ended.

Following each of the routines of FIGS. 15 to 19, the control of the CPU 63 proceeds with Step S16 of FIG. 14 to store, in the stitch position data memory of the RAM 65, the sets of coordinate data for the first and fourth defining points P1, P4 and the intermediate points therebetween, as sets of stitch position data representative of respective stitch positions where the sewing needle 20 penetrates the work fabric held by the workholder 34 to form respective stitches and thereby embroider a corresponding one of the block patterns BP1 to BP 5. The sets of stitch position data stored in the RAM 65 may be transferred to be recorded on a floppy disk set in the FDD 74. Thus, one cycle of the control program of FIG. 14 is ended.

Figure 20:
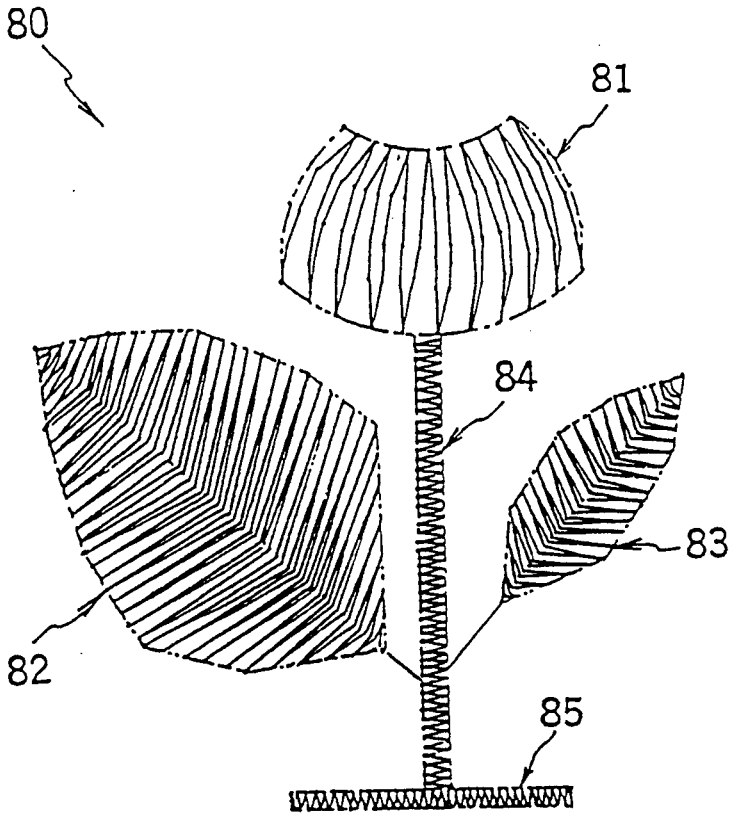
FIG. 20 is a view of a "flower" pattern as an example of a embroidery area and respective stitches formed in the "flower" pattern by the sewing system of FIG. 2.
Figure 21:
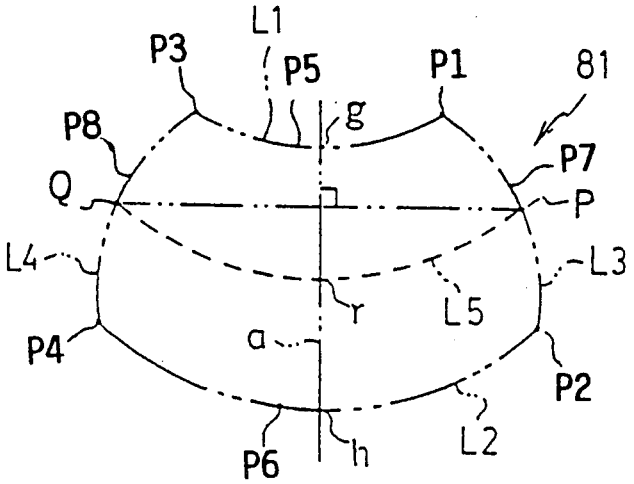
FIG. 21 is a view of four defining points and four aid points located on the outline of a "petal" block of the flower pattern of FIG. 20.
Figure 22:
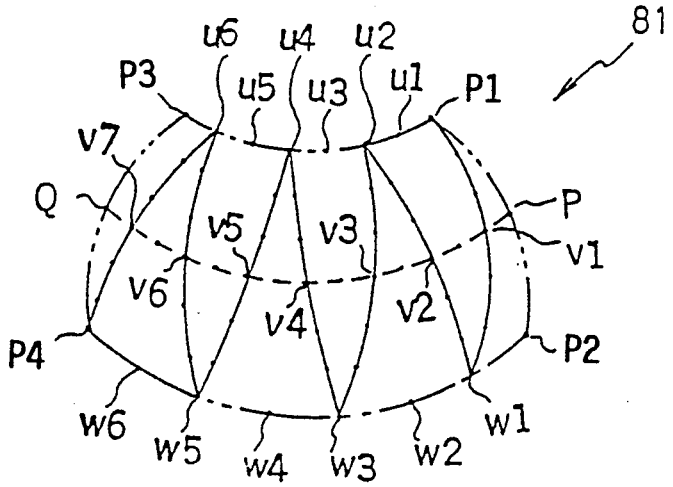
FIG. 22 is a view of stitch positions determined on the outline of the "petal" block of FIG. 21 and respective stitches formed in the "petal" block.
Figure 23:
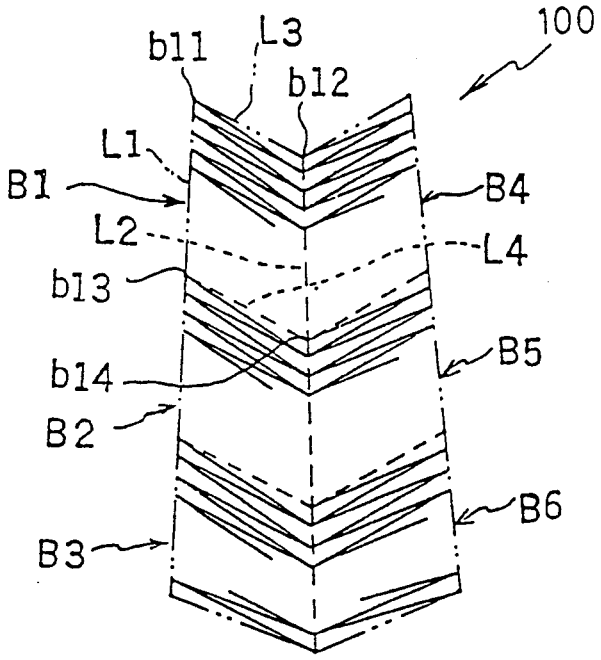
PRIOR ART FIG. 23
FIG. 23 is a view of small blocks which are utilized in the prior art to produce embroidery data for forming an embroidery in an embroidery area consisting of the small blocks.

In the event that the image scanner 60 reads in a "flower" pattern 80 as shown in FIG. 20, it is assumed that the operator select the fifth block pattern BP5 for a "petal" block 81 of the "flower" pattern 80. In this case, in Step S14 of FIG. 14, the operator inputs, by using the mouse 59, sets of coordinate data for first to fourth defining points P1 to P4, two aid points P5, P6 respectively specified on first and second main segments L1, L2, and two aid points P7, P8 respectively specified on first and second secondary segments L3, L4, as shown in FIG. 21. Consequently, the data processing device 55 automatically produces sets of stitch position data for forming respective stitches filling the "petal" block 81 and thereby embroidering the "petal" block 81, as shown in FIG. 22. In addition, providing that the operator apply the second block pattern BP2 to each of two "leaf" blocks 82, 83 of the "flower" pattern 80, and apply the first block pattern BP1 to each of a "stem" block 84 and a "ground" block 85, the data processing device 55 produces sets of stitch position data for embroidering the respective parts 82, 83, 84, 85 of the flower pattern 80, as shown in FIG. 20.

As is apparent from the foregoing description, the data processing device 55 produces embroidery data (i.e., sets of stitch position data), directly (i.e., without having to further divide), based on a single block (i.e., embroidery are) which may have a variety of outlines whose main segments L1, L2 may be a straight line (block patterns BP1 to BP3), a circular arc (BP4 to BP6), or a spline curve (BP7 to BP10) and whose secondary segments L3, L4 may be a polygonal line (BP2 to BP4, BP6 to BP8), a circular arc (BP5, BP9), or a spline curve. Thus, the processing device 55 contributes to largely reducing the number of blocks as divisions of an original image or area to be embroidered. In the case where an original image to be embroidered is divided into blocks and is stored in the form of a set of pattern outline data including sets of block data each of which is representative of the outline of a corresponding one of the blocks, the processing device 55 stores a largely reduced amount of pattern outline data or block data for the original image. The pattern outline data may be stored in the external storage device 58. In addition, the processing device 55 extremely facilitates the operation of preparing pattern outline data.

Furthermore, the data processing device 55 determines an aid main segment L5, L6, L7 connecting between the two secondary segments L3, L4, such that the shape of the aid main segment L5, L6, L7 matches the shapes of the main segments L1, L2, and determines stitch positions on the aid main segment L5, L6, L7 such that the stitch positions are influenced by the shapes of the secondary segments L3, L4. Therefore, an operator can divide an original image into blocks whose secondary segments have a variety of shapes. Thus, the processing device 55 produces sets of stitch position data for forming ideal embroidery stitches reflecting the whole shape of the outline of each of the blocks, i.e., shapes of the main and secondary segments L1, L2, L3, L4 of each block.

Figure 24:
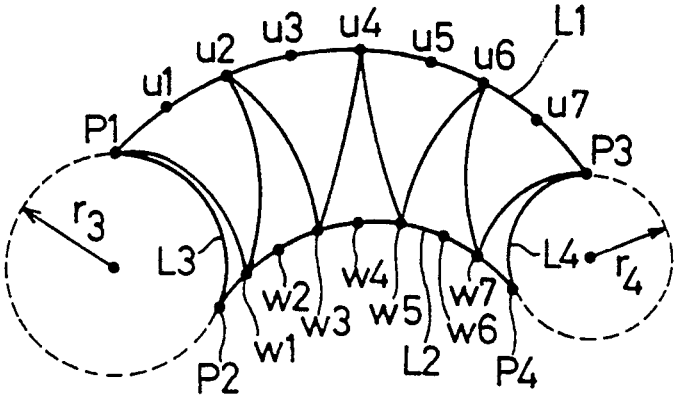
FIG. 24 is a view of a block pattern as an example of an embroidery area having a pair of main segments each defined by a circular arc and a pair of secondary segments each defined by a circular arc, and respective stitches formed in the block pattern.

Referring next to FIG. 24, there is shown a different block pattern for which the embroidery sewing system 1 of FIG. 1 produces embroidery data, i.e., stitch position data. A set of basic data for this block pattern, based on which the sewing system 1 produces embroidery data, is different in structure from those for the block patterns BP1 to BP10.

Figure 30:
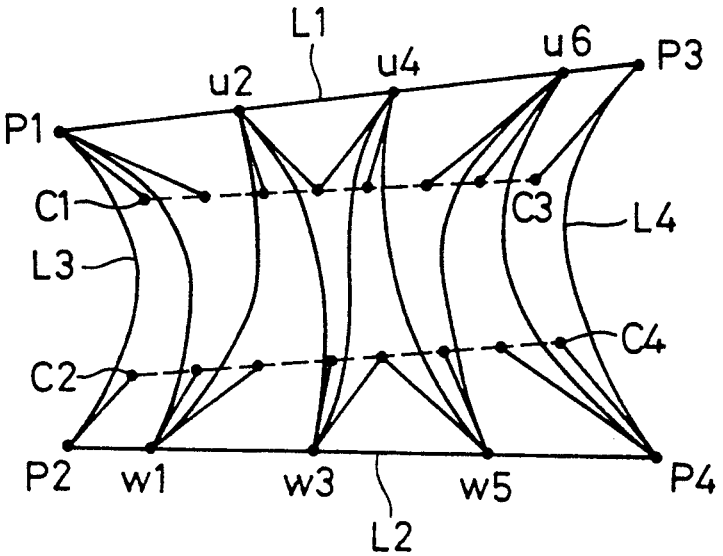
FIG. 30 is a view of a block pattern as an example of an embroidery area having a pair of main segments each defined by a straight line and a pair of secondary segments each defined by a Bezier curve, and respective stitches formed in the block pattern.

Specifically described, this block has two main segments L1, L2 and two secondary segments L3, L4. The block has four defining points P1 to P4, which cooperate with other data to define the outline of the block and additionally specify the stitch forming direction in which respective stitches are formed to fill the block. The first and third defining points P1, P3 defines the first main segment L1, the second and fourth defining points P2, P4 defines the second main segment L2, the first and second defining points P1, P2 defines the first secondary segment L3, and the third and fourth defining points P3, P4 defines the second secondary segment L4. FIG. 30 shows the structure of the set of basic data for the block of FIG. 24. Each of the four segments L1 to L4 is represented by two sets of point data indicative of the positions of the start and end points of the each segment, and a set of shape defining data for defining the shape of the each segment (in this example, all the segments L1 to L4 are circular arcs). A set of shape defining data includes, in addition to data indicative of a circular arc as the shape of a segment $L_n$ (n=1, 2, 3, 4), data indicative of an orientation ("concave" or "convex") of the circular arc as viewed from inside the block, and data indicative of a radius ($r_n$) of the circular arc.

Figure 27A:
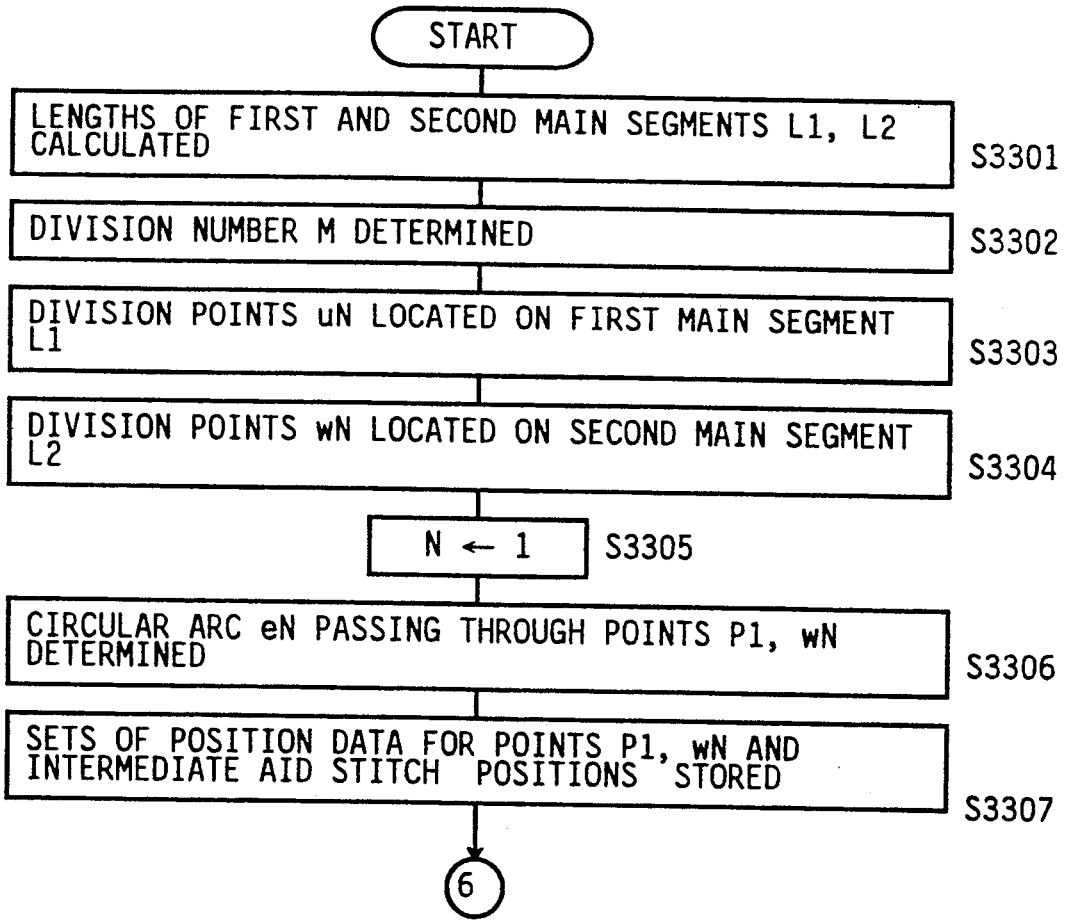
FIGS. 27A & 27B are flow charts representing the sub-routine for producing embroidery data for the block pattern of FIG. 24.
Figure 27B:
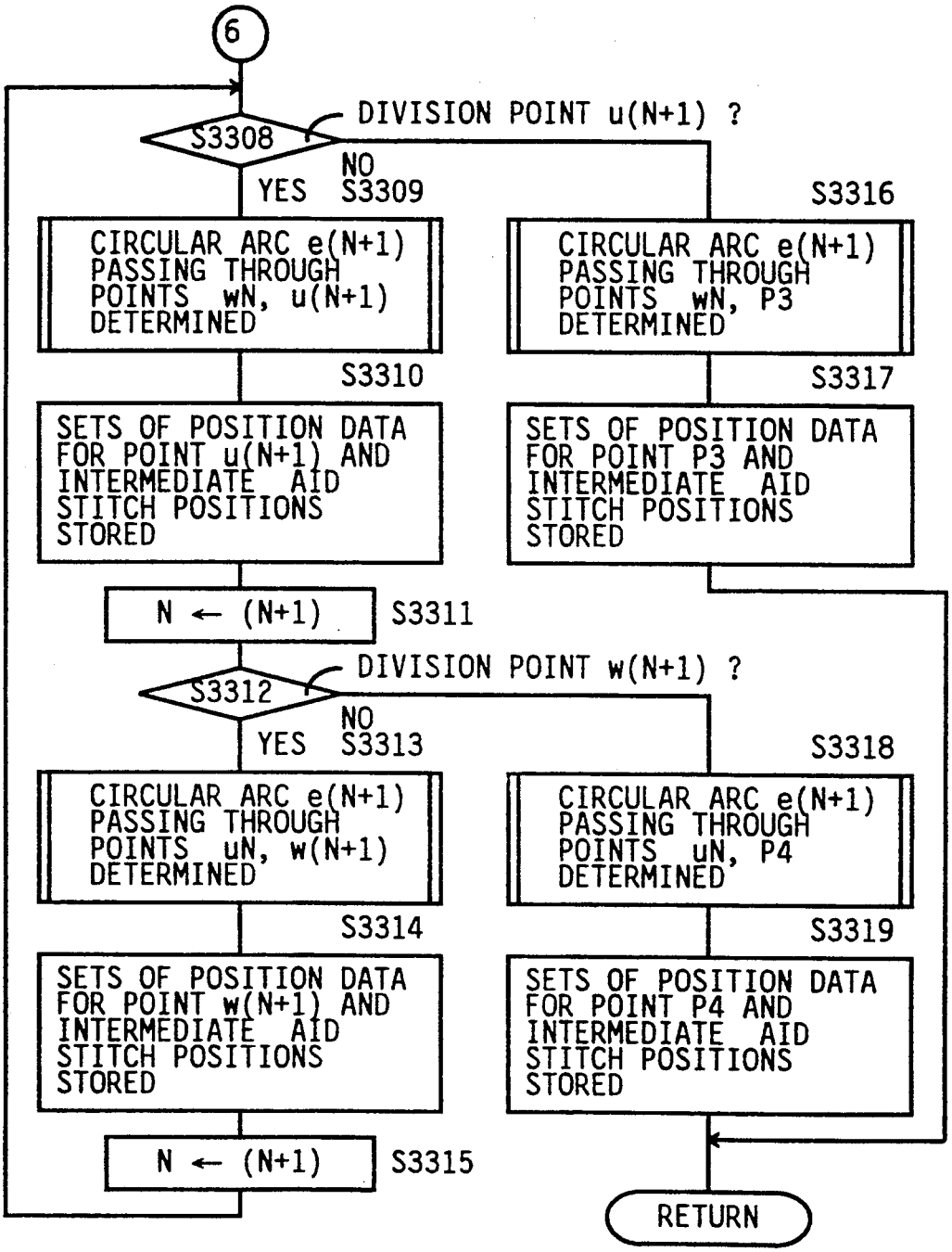
Figure 28:
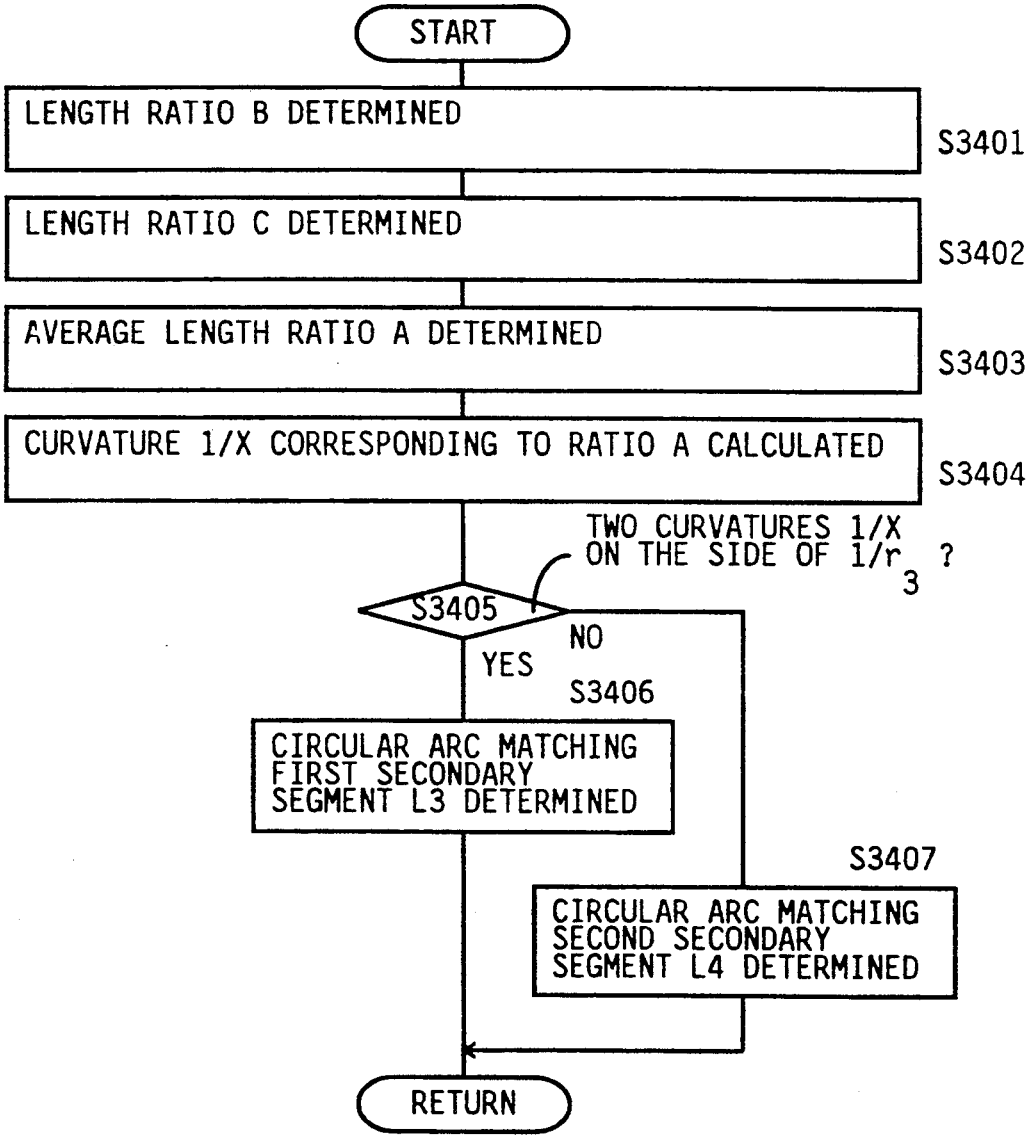
FIG. 28 is a flow chart representing the sub-routine for determining a circular arc as each of the path segments of the stitch forming path for the block pattern of FIG. 24.

By reference to FIG. 27 (27A & 27B) and FIG. 28, there will be described the operation of producing sets of stitch position data based on the above-described set of basic data. FIG. 28 shows the sub-routine for determining a circular arc, which is effected in the implementation of the routine of FIG. 27.

In Step S3301 of FIG. 7, the control device 78 or CPU 63 specifies, based on the basic data, the two main segments or circular arcs L1, L2, and determines the girth lengths of the circular arcs L1, L2. In the next step S3302, the CPU 63 calculates a division number, M, according to the following expression: $M=(L1+L2)/2t$, wherein t is a stitch density defined as stitch pitch as measured in the stitch forming direction of the pertinent block, that is, length in which a stitch is formed in the stitch forming direction of the block. For example, t=0.2 mm means that five stitches are formed in a 1 mm length. In Step S3303, the length of the first main segment L1 is divided by the division number M so that, starting from the first defining point P1, division points, uN, are located equidistant from each other on the first main segment L1. Sets of position data representative of the positions of the points P1, uN, P3 are stored in sequence in the division position data buffer of the RAM 65. Similarly, in Step S3304, the length of the second main segment L2 is divided by the division number M so that, starting from the second defining point P2, division points, wN, are located equidistant from each other on the second main segment L2. Sets of position data representative of the positions of the points P2, wN, P4 are stored in sequence in the division position data buffer of the RAM 65. In Step S3305, a counter N is set to one ("1").

In Step S3306, a circular arc, eN, passing through the points P1 and w1 is determined according to the subroutine of FIG. 28 (described later). Since the secondary segments L3, L4 of this block are both circular arcs, a circular arc is utilized as each of respective segments of a stitch forming path which alternately turns at the pair of opposed main segments L1, L2 while advancing in the stitch forming direction. Consequently, the shape of each of the path segments of the stitch forming path matches the shapes of the secondary segments L3, L4. When the sewing needle 20 of the sewing machine 2 forms respective stitches along the stitch forming path, the block is filled with a stitch line consisting of a series of the stitches, so that an embroidery is provided in the block. Since with respect to the present block the path segments of the stitch forming path are defined by circular arcs, a plurality of aid stitch positions are located at a pre-selected stitch pitch intermediate on the trace of each of those circular arcs. In contrast, with respect to the block patterns BP2 to BP4 and BP6 to BP8, a polygonal line is utilized as each of path segments of a stitch forming path therefor. Stated differently, a single aid stitch position may be located intermediate on each of the path segments. In the latter case, the single stitch position is the single vertex of the polygonal line as each path segment. In Step S3307, the sets of position data for the defining point P1, aid stitch positions, and division point w1 are stored in the stitch position data buffer of the RAM 65 in the order of description.

Subsequently, the control of the CPU 63 proceeds with Step S3308 to identify whether or not there is left the set of position data for the division point, u(N+1), on the opposite main segment L1. If an affirmative judgement is made in Step S3308, the control goes to Step S3309 to determine an circular arc, e(N+1), passing through the division points w1, u(N+1) according to the sub-routine of FIG. 28. In Step S3310, aid stitch positions are located intermediate on the circular arc e(N+1), as described with respect to Step S3306, and sets of position data for the aid stitch positions and the division point u(N+1) are stored in the stitch position data buffer in the order of description. In Step S3311, the counter N is incremented by one, and thereafter the control of the CPU 63 goes to Step S3312.

On the other hand, if a negative judgement is made in Step S3308, this means that stitching will terminate at the third defining point P3 on the first main segment L1. In this case, the control of the CPU 63 goes to Step S3316 to determine an circular arc, e(N+1), passing through the points wN, P3 according to the sub-routine of FIG. 28. In Step S3317, the CPU 63 locates aid stitch positions intermediate on the circular arc e(N+1), as described with respect to Step S3306, and store sets of position data for the division point wN, aid stitch positions, and third defining point P3 in the stitch position data buffer in the order of description. Then, the control of the CPU 63 proceeds to Step S16 of FIG. 14.

In Step S3312, the CPU 63 identifies whether or not there is left the set of position data for the division point, w(N+1), on the opposite main segment L2. If an affirmative judgement is made in Step S3312, the control goes to Step S3313 to determine an circular arc, e(N+1), passing through the division points uN, w(N+1) according to the sub-routine of FIG. 28. In Step S3314, aid stitch positions are located intermediate on the circular arc e(N+1), as described with respect to Step S3306, and sets of position data for the aid stitch positions and the division point w(N+1) are stored in the stitch position data buffer in the order of description. In Step S3315, the counter N is incremented by one, and thereafter the control of the CPU 63 proceeds with Step S3308.

On the other hand, if a negative judgement is made in Step S3312, this means that stitching will terminate at the fourth defining point P4 on the second main segment L2. In this case, the control of the CPU 63 goes to Step S3318 to determine an circular arc, e(N+1), passing through the division point uN and the fourth defining point P4, according to the sub-routine of FIG. 28. In Step S3319, the CPU 63 locates aid stitch positions intermediate on the circular arc e(N+1), as described with respect to Step S3306, and store sets of position data for the aid stitch positions and the fourth defining point P4 in the stitch position data buffer in the order of description. Then, the control of the CPU 63 proceeds with Step S16 of FIG. 14.

Next, by reference to FIGS. 26 and 28, there will be described the manner to determine a circular arc in each of Steps S3306, S3309, S3313, S3316, and S3318.

First, in Step S3401, the CPU 63 determines a ratio, B, of the girth length of the circular arc segment between the start point of the pertinent circular arc eN, e(N+1) and the start end of the main segment L1 or L2 on which that start point is located, to the entire girth length of that main segment L1 or L2. Similarly, in Step S3402, the CPU 63 determines a ratio, C, of the girth length of the circular arc segment between the end point of the circular arc eN, e(N+1) and the start end of the opposite main segment L2 or L1 on which that end point is located, to the entire girth length of that opposite main segment L2 or L1. For example, with respect to a circular arc, e2, the start and end points of the arc e2 are the division points w1 and u2, respectively, because the stitch forming path advances from the point w1 toward the point u2. Since the two main segments L1, L2 each are equally divided into eight segments, the ratio B is $\frac{1}{8}$ and the ratio C is 2/8 ($=\frac{1}{4}$).

Subsequently, in Step S3403, the CPU 63 determines an average value, A, of the ratios B and C according to the following expression: $A=(B+C)/2$. As is apparent from the foregoing description, the value A is indicative of the relative position of the circular arc eN, e(N+1) intermediate between the two secondary segments L3, L4. By deforming the shapes of the secondary segments L3, L4 depending upon the relative position A of the circular arc eN, e(N+1), it is possible to obtain a desired shape of the circular arc which smoothly matches the shapes of the secondary segments L3, L4, so that excellent stitches can be formed along the trace of the circular arc as a path segment at that relative position. To this end, a degree of curvature, 1/X, corresponding to the value A is determined according to the graph of FIG. 26. The value X is indicative of the radius of the circular arc.

Figure 26:
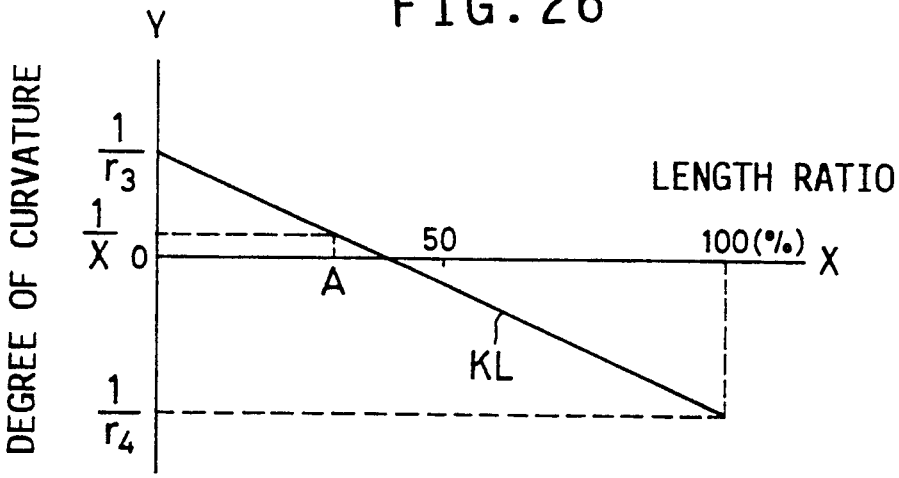
FIG. 26 is a view of a graph for explaining the manner to determine a degree of curvature of a circular arc as each of path segments of a stitch forming path on which respective stitches are formed to embroider the block pattern of FIG. 24.

The graph of FIG. 26 is obtained as follows: First, two points (0, $1/r_3$) and (100, $1/r_4$) are plotted in the X-Y coordinate plane. If the orientations ("concave" or "convex" ) of the two secondary segments L3, L4 are identical with each other, the two points are located in the positive and negative areas with respect to the Y axis, respectively; on the other hand, if the orientations of the two secondary segments L3, L4 are different from each other, the two points are both located in one of the positive and negative areas with respect to the Y axis. In the example of the block shown in FIG. 24, the orientations of the two secondary segments L3, L4 are identical with each other, the two points are located in the positive and negative areas with respect to the Y axis, respectively. The X axis is indicative of the average value A of the length ratios B and C. Finally, a straight line, KL, passing through the two points (0, $1/r_3$), (100, $1/r_4$) is determined. In Step S3404, the CPU 63 determines a degree of curvature 1/X (i.e., inverse of a radius) of the circular arc eN, e(N+1), corresponding to the value A, according to the straight line KL.

In Step S3405, the CPU 63 identifies whether or not the point (A, 1/X) is positioned in the same area with respect to the Y axis as the area in which the point (0, $1/r_3$) is positioned. If an affirmative judgement is made in Step S3405, this means that the current circular arc eN, e(N+1) has the same orientation as that of the circular arc L3. In this case, the control of the CPU 63 goes to Step S3406 to determine a circular arc connecting between the above-described start and end points thereof, having the radius of X, and having the same orientation as that of the circular arc L3. Then, the control of the CPU 63 returns to the appropriate step S3306, S3309, S3313, S3316, or S3318. On the other hand, if a negative judgement is made in Step S3405, this means that the current circular arc eN, e(N+1) has the same orientation as that of the circular arc L4. In this case, the control of the CPU 63 goes to Step S3407 to determine a circular arc connecting between the above-described start and end points thereof, having the radius of X, and having the same orientation as that of the circular arc L4. Then, the control of the CPU 63 returns to the appropriate step S3306, S3309, S3313, S3316, or S3318.

As described above, desired stitches are formed automatically and efficiently based on data representative of the main and secondary outline segments of a block as an embroidery area or a part of an embroidery area.

Figure 29:
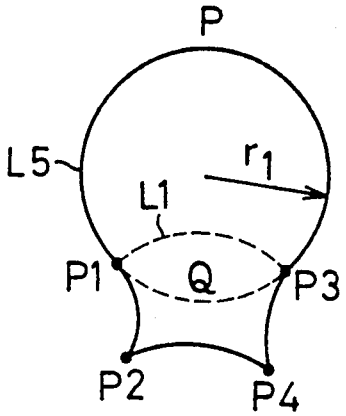
FIG. 29 is a view for explaining the manner in which the embroidery area data of FIG. 25 specifies the block pattern of FIG. 24.

The data for the first main segment L1, for example, can define two circular arcs, L1 and L5, as shown in FIG. 29. However, in the present embodiment, the control device 78 is pre-programmed such that that the shorter one of the two circular arcs is employed, because if the longer one (this is longer than half the entire circumference) is selected some stitches would probably come out of the outline of the block. Alternatively, it is possible that the data for each circular arc outline segment further include data indicative of which one of longer and shorter circular arcs the pertinent circular arc is defined by.

While the basic data for the block pattern of FIG. 24 includes sets of position data for four defining points P1 to P4, it is possible to define three or four circles each with data indicative of the center, radius, and orientation thereof and use the four intersections of those circles as four defining points P1 to P4 of a block pattern. Thus, according to the principle of the present invention, it is not essentially required that a set of basic data for a block pattern include sets of position data representative of four defining points P1 to P4 on the outline of the block pattern.

While the present invention has been described in detail with respect to the preferred embodiments thereof, it is to be understood that the present invention may be embodied with various changes, improvements and modifications that may occur to those skilled in the art without departing from the scope and spirit of the invention defined in the appended claims.

Figure 31:
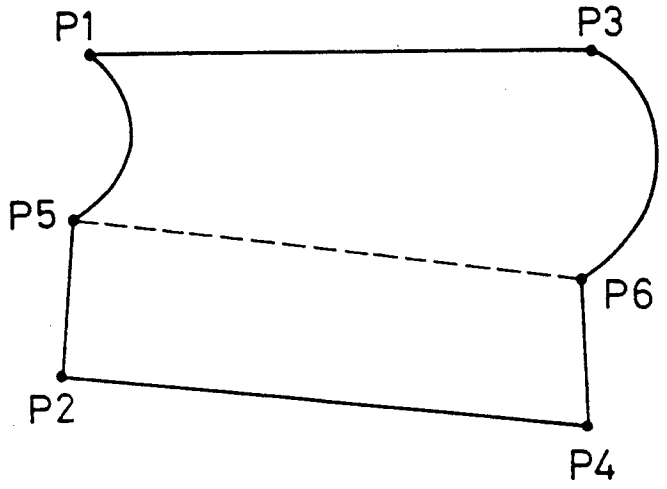
FIG. 31 is a view of a block pattern as an example of an embroidery area having a pair of main segments each defined by a straight line, and a pair of secondary segments each defined by a straight line and a circular arc connected with each other.
Figure 32:
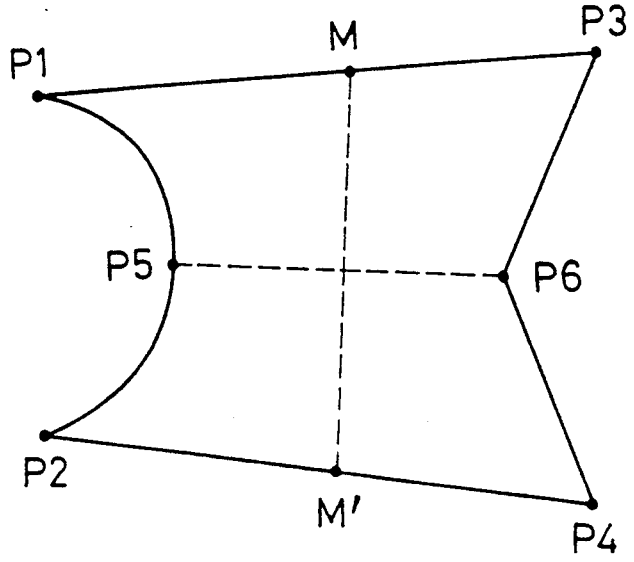
FIG. 32 is a view of a block pattern as an example of an embroidery area having a pair of main segments each defined by a straight line, and a pair of secondary segments one of which is defined by a circular arc and the other of which is defined by a polygonal line.

For example, while in the illustrated embodiment a spline curve is used as a free-form curve for defining a main or secondary outline segment of a block pattern, it is possible to use as a free-form curve a Bezier curve which is specified by two end points and two control points. FIG. 30 shows a block pattern whose main segments L1, L2 are straight lines and whose secondary segments L3, L4 are Bezier curves, and the Bezier curves as respective path segments of a stitch forming path along which stitches are formed to fill the block pattern. In addition, the present invention is applicable to a block pattern as shown in FIG. 31, in which two main segments thereof are straight line segments and each of two secondary segments thereof consists of a circular arc and a straight line segment connected to the circular arc. Furthermore, the present invention is applicable to a block pattern as shown in FIG. 32, in which two main segments thereof are straight line segments, one of two secondary segments thereof is a circular arc, and the other secondary segment is a polygonal line segment. In the latter case, two points, M and M', are located at the midpoints of the two main segments, respectively, and respective path segments of a stitch forming path for the block pattern are determined such that the path segments have a shape more approximate to a straight line as they approach a straight line segment connecting between the points M, M'.

While the data processing device 55 produces, for example for the first block pattern BP1, embroidery data for providing a "V-shape stitch" embroidery by sequentially connecting with thread the stitch positions P1, v1, u2, v3, . . . , it is possible to adapt the processing device 55 to produce embroidery data for providing a "N-shape stitch" embroidery by sequentially connecting stitch positions P1, P2, u1, v1, u2, v2, u3, v3, . . . which additionally includes the stitch positions P2, v1, v2, u3, . . . . This applies to the other block patterns BP2 to BP10. The embroidery data production control program represented by the flow chart of FIG. 14 may be stored in the external storage device 58. The data processing device 55 may be incorporated into the embroidery sewing machine 2.

What is claimed is:

1. A process of (a) producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, and (b) utilizing the sets of stitch position data to form a stitch line comprising a series of the stitches and alternately turning at the opposed main outline segments, thereby providing an embroidery in the embroidery area, the process comprising the steps of:

specifying a set of secondary outline segment shape defining data defining a shape of each of said secondary outline segments such that the space of said each secondary outline segment is different from a straight line segment;

producing, based on said main outline segment data and said secondary outline segment shape defining data, said sets of stitch position data which are representative of respective stitch positions located on a stitch forming path alternately turning at said opposed main outline segments, said stitch forming path comprising a plurality of path segments each of which connects between said main outline segments and has a shape influenced by the shapes of said secondary outline segments, said sets of stitch position data including at least one set of stitch position data representative of at least one stitch position located on an intermediate portion of said each path segment excluding opposite ends thereof on said main outline segments; and forming said series of stitches based on said sets of stitch position data.

2. The process according to claim 1, wherein the specifying step comprises specifying said secondary outline segment shape defining data including at least two sets of aid point data defining at least two aid points including at least one aid point located on each of said secondary outline segments.

3. The process according to claim 1, wherein the specifying step comprises specifying said secondary outline segment shape defining data defining, as the shape of each of said secondary outline segments, at least one of a polygonal line, a circular arc, and a free-form curve, and the producing step comprises producing said stitch position data based on said secondary outline segment shape defining data and said main outline segment data including a set of main outline segment shape defining data defining, as a shape of each of said main outline segments, at least one of a straight line, a polygonal line, a circular arc, and a free-form curve.

4. The process according to claim 1, wherein the specifying step comprises specifying said secondary outline segment shape defining data including at least two sets of aid point data defining at least two aid points including at least one aid point located on each of said secondary outline segments, and the producing step comprises (a) producing, based on said aid point data, at least one set of aid line data representative of at least one aid line each of which passes through a corresponding pair of aid points out of said at least two aid points one point of which pair is located on one of said secondary outline segments and the other point of which pair is located on the other of said secondary outline segments, and (b) producing, based on said main outline segment data. said aid line data, and stitch density data, said stitch position data including sets of stitch position data representative of stitch positions located on said at least one aid line.

5. The process according to claim 1, wherein the producing step comprises a step of producing stitch forming path data representative of said stitch forming path, and a step of producing said stitch position data based on said stitch forming path data and said main outline segment data.

6. The process according to claim 5, wherein the specifying step comprises specifying said secondary outline segment shape defining data defining, as the shape of each of said secondary outline segments, at least one of a polygonal line, a circular arc, and a free-form curve, and the step of producing said stitch forming path data comprises producing said stitch forming path data representative of said stitch forming path consisting of said path segments each of which includes at least one of a polygonal line, circular arc, and a free-form curve such that said each path segment has a shape influenced by the shapes of said secondary outline segments.

7. The process according to claim 5, wherein the specifying step comprises specifying said secondary outline segment shape defining data including at least two sets of aid point data defining at least two aid points including at least one aid point located on each of said secondary outline segments, and the producing step comprises (a) a step of producing, based on said main outline segment data, at least one set of aid line data representative of at least one aid line each of which passes through a corresponding pair of aid points out of said at least two aid points one point of which pair is located on one of said secondary outline segments and the other point of which pair is located on the other of said secondary outline segments, and (b) the step of producing said stitch forming path data wherein said stitch forming path data is produced based on said aid line data and said secondary outline segment shape defining data.

8. The process according to claim 7, wherein the step of producing said stitch forming path data comprises producing said stitch forming path data, further based on stitch density data for said at least one aid line.

9. The process according to claim 7, wherein the specifying step comprises specifying said main outline segment data including sets of end position data representative of respective positions of opposite ends of each of said main outline segments, and a set of main outline segment shape defining data defining a shape of said each main outline segment.

10. The process according to claim 9, wherein the specifying step comprises specifying said main outline segment data including said main outline segment shape defining data defining, as the shape of said each main outline segment, at least one of a straight line, a polygonal line, a circular arc, and a free-form curve, and the producing step comprises producing said aid line data representative of said at least one aid line each of which includes at least one of a straight line, a polygonal line, a circular arc, and a free-form curve such that said each aid line has a shape influenced by the shapes of said main outline segments.

11. The process according to claim 1, wherein the specifying step comprises specifying said secondary outline segment shape defining data including at least two sets of aid point data defining at least two aid points including at least one aid point located on each of said secondary outline segments, and the producing step comprises (a) producing, based on said aid point data and said main outline segment data including a set of main outline segment shape defining data defining a shape of each of said main outline segments, at least one set of aid line data representative of at least one aid line each of which passes through a corresponding pair of aid points out of said at least two aid points one point of which pair is located on one of said secondary outline segments and the other point of which pair is located on the other of said secondary outline segments, such that said each aid line has a shape influenced by the shapes of said main outline segments, and (b) producing said stitch position data based on said aid line data, said main outline segment data, said secondary outline segment shape defining data, and pre-specified stitch density data.

12. The process according to claim 11, wherein the specifying step comprises specifying said secondary outline segment shape defining data defining a pair of polygonal lines each of which contains, as at least one vertex thereof, a same number of said at least one aid point out of said at least two aid points, and the producing step comprises (a) producing, based on said secondary outline segment shape defining data and said main outline segment data including said main outline segment shape defining data defining a pair of straight lines, said aid line data representative of said at least one aid line each of which is a straight line passing through said corresponding pair of aid points out of said at least two aid points, and (b) producing stitch forming path data representative of said stitch forming path consisting of said path segments each of which is a polygonal line having a vertex located on each of said at least one aid line.

13. The process according to claim 11, wherein the specifying step comprises specifying said secondary outline segment shape defining data defining a pair of polygonal lines each of which contains, as at least one vertex thereof, a same number of said at least one aid point out of said at least two aid points, and the producing step comprises (a) producing, based on said secondary outline segment shape defining data and said main outline segment data representative of a pair of circular arcs each of which has opposite ends and passes through an aid point located intermediate between the opposite ends thereof, said aid line data representative of said at least one aid line each of which is a circular arc having as opposite ends thereof said corresponding pair of aid points out of said at least two aid points and passing through an aid point which is located intermediate between said corresponding pair of aid points based on positions of the aid points on the circular arcs as said main outline segments, and (b) producing said stitch forming path data representative of said stitch forming path consisting of said path segments each of which is a polygonal line having a vertex located on each of said at least one aid line.

14. The process according to claim 11, wherein the specifying step comprises specifying said secondary outline segment shape defining data defining a pair of circular arcs each of which has as opposite ends thereof a corresponding pair of opposed ends of said pair of main outline segments and passes through an aid point located between said corresponding pair of opposed ends, and the producing step comprises (a) producing, based on said secondary outline segment shape defining data and said main outline segment data representative of a pair of circular arcs each of which has opposite ends and passes through an aid point located intermediate between the opposite ends thereof, said aid line data representative of said at least one aid line each of which is a circular arc having as opposite ends thereof said corresponding pair of aid points out of said at least two aid points and passing through an aid point which is located intermediate between said corresponding pair of aid points based on positions of the aid points on the circular arcs as said main outline segments, and (b) producing said stitch forming path data representative of said stitch forming path consisting of said path segments each of which is a circular arc.

15. The process according to claim 11, wherein the specifying step comprises specifying said secondary outline segment shape defining data defining a pair of polygonal lines each of which contains, as at least one vertex thereof, a same number of said at least one point out of said at least two aid points, and the producing step comprises (a) producing, based on said secondary outline segment shape defining data and said main outline segment data representative of a pair of free-form curves each of which has opposite ends and is defined by a plurality of aid points, said aid line data representative of said at least one aid line each of which is a free-form curve having as opposite ends thereof the aid points on the polygonal lines as said secondary outline segments and defined by a plurality of aid points located based on positions of the aid points on the free-form curves as said main outline segments, and (b) producing said stitch forming path data representative of said stitch forming path consisting of said path segments each of which is a polygonal line having a vertex located on each of said at least one aid line.

16. The process according to claim 11, wherein the specifying step comprises specifying said secondary outline segment shape defining data defining a pair of circular arcs each of which has as opposite ends thereof a corresponding pair of opposed ends of said pair of main outline segments and passes through an aid point located between said corresponding pair of opposed ends, and the producing step comprises (a) producing, based on said secondary outline segment shape defining data and said main outline segment data defining a pair of free-form curves each of which has opposite ends and is defined by a plurality of aid points, said aid line data representative of said at least one aid line each of which is a free-form curve having as opposite ends thereof the aid points on the circular arcs as said secondary outline segments and defined by a plurality of aid points located based on positions of the aid points on the free-form curves as said main outline segments, and (b) producing said stitch forming path data representative of said stitch forming path consisting of said path segments each of which is a circular arc.

17. The process according to claim 11, wherein the specifying step comprises specifying said secondary outline segment shape defining data defining a pair of free-form curves each of which has as opposite ends thereof a corresponding pair of opposed ends of said pair of main outline segments and is defined by a plurality of aid points, and the producing step comprises producing, based on said secondary outline segment shape defining data and said main outline segment data representative of a pair of free-form curves each of which has opposite ends and is defined by a plurality of aid points, said aid line data representative of said at least one aid line each of which is a free-form curve having as opposite ends thereof the aid points on the free-form curves as said secondary outline segments and defined by a plurality of aid points located based on positions of the aid points on the free-form curves as said main outline segments, and (b) producing said stitch forming path data representative of said stitch forming path consisting of said path segments each of which is a free-form curve.

18. The process according to claim 1, wherein the specifying step comprises specifying at least two sets of control point data representative of at least two control points including at least one control point which cooperates with each of two pairs of opposed ends of said opposed main outline segments, to define a Bezier curve as a shape of a corresponding one of said secondary outline segments, and the producing step comprises producing, based on said control point data and said main outline segment data, said stitch position data.

19. A process of (a) producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, and (b) utilizing the sets of stitch position data to form a stitch line comprising a series of the stitches and alternately turning at the opposed main outline segments, thereby providing an embroidery in the embroidery area, the process comprising the steps of:

specifying at least two sets of aid point data representative of at least two aid points including at least one point which is located on each of said secondary outline segments and defines a shape of said each secondary outline segment;

producing, based on said aid point data and said main outline segment data, said sets of stitch position data which are representative of respective stitch position located on a stitch forming path alternately turning at said opposed main outline segments, said stitch forming path consisting of a plurality of path segments each of which connects between said main outline segments and has a shape influenced by the shapes of said secondary outline segments, said sets of stitch position data including at least one set of stitch position data representative of at least one stitch position located on an intermediate portion of said each path segment excluding opposite ends thereof on said main outline segments; and forming said series of stitches based on said sets of stitch position data.

20. An apparatus for (a) producing, based on main outline segment data representative of a pair of opposed main outline segments which define an embroidery area by cooperating with a pair of opposed secondary outline segments connecting between corresponding pairs of opposed ends of the main outline segments, sets of stitch position data representative of respective stitch positions where a sewing needle of a sewing machine penetrates a work sheet to form respective stitches with a sewing thread, and (b) utilizing the sets of stitch position data to form a stitch line comprising a series of the stitches and alternately turning at the opposed main outline segments, thereby providing an embroidery in the embroidery area, the apparatus comprising:

means for specifying a set of secondary outline segment shape defining data defining a shape of each of said secondary outline segments such that the shape of said each secondary outline segment is different from a straight line segment;

means for producing, based on said main outline segment data and said secondary outline segment shape defining data, said sets of stitch position data which are representative of respective stitch positions located on a stitch forming path alternately turning at said opposed main outline segments, said stitch forming path comprising a plurality of path segments each of which connects between said main outline segments and has a shape influenced by the shapes of said secondary outline segments, said sets of stitch position data including at least one set of stitch position data representative of at least one stitch position located on an intermediate portion of said each path segment excluding opposite ends thereof on said main outline segments; and data utilization means for utilizing said sets of stitch position data to form said series of stitches.

21. The apparatus according to claim 20, further comprising:

a keyboard operable by an operator for inputting data;

an image scanner for reading in said main outline segments and said secondary outline segments;

a display device having a screen for displaying a figure including the main and secondary outline segments read in by said image scanner; and a coordinate data input device operable by the operator for specifying a point on said screen of said display and inputting a coordinate position of said point specified on said display.

22. A sewing system including a sewing needle which penetrates a work sheet to form stitches with a sewing thread such that a stitch line comprising a series of the stitches alternately turns at a pair of opposed main outline segments which define an embroidery area by cooperating with a pair of opposed secondary outline segments connecting between corresponding pairs of opposed ends of the main outline segments, the stitch line providing an embroidery in the embroidery area, the system comprising:

(A) a data producing apparatus for producing, based on main outline segment data representative of said pair of main outline segments, sets of stitch position data representative of respective stitch positions where said sewing needle penetrates said work sheet to form said series of stitches, the data producing apparatus including means for specifying a set of secondary outline segment shape defining data defining a shape of each of said secondary outline segments such that the shape of said each secondary outline segment is different from a straight line segment, and means for producing, based on said main outline segment data and said secondary outline segment shape defining data, said sets of stitch position data which are representative of respective stitch positions located on a stitch forming path alternately turning at said opposed main outline segments, said stitch forming path comprising a plurality of path segments each of which connects between said main outline segments and has a shape influenced by the shapes of said secondary outline segments, said sets of stitch position data including at least one set of stitch position data representative of at least one stitch position located on an intermediate portion of said each path segment excluding opposite ends thereof on said main outline segments; and (B) a sewing machine including said sewing needle for forming said series of stitches by utilizing said sets of stitch position data produced by said data producing apparatus.

23. The process according to claim 1, wherein the forming step comprises forming said series of stitches using said sewing needle in accordance with said sets of stitch position data.

24. The process according to claim 1, wherein the forming step comprises recording said sets of stitch position data on a recording medium which is movable for use with said sewing machine including said sewing needle.

25. The apparatus according to claim 20, wherein the data utilization means comprises said sewing needle for forming said series of stitches in accordance with said sets of stitch position data.

26. The apparatus according to claim 20, wherein the data utilization means comprises means for recording said sets of stitch position data on a recording medium which is movable for use with said sewing machine including said sewing needle.

* * * * *